US006654549B1

(12) United States Patent
Konishi

(10) Patent No.: US 6,654,549 B1
(45) Date of Patent: Nov. 25, 2003

(54) INFRARED LIGHT BULB, HEATING DEVICE, PRODUCTION METHOD FOR INFRARED LIGHT BULB

(75) Inventor: Masanori Konishi, Takamatsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 172 days.

(21) Appl. No.: 09/890,115

(22) PCT Filed: Nov. 24, 2000

(86) PCT No.: PCT/JP00/08313

§ 371 (c)(1),
(2), (4) Date: Jul. 26, 2001

(87) PCT Pub. No.: WO01/41507

PCT Pub. Date: Jun. 7, 2001

(30) Foreign Application Priority Data

Nov. 30, 1999 (JP) ..... 11-340784
Feb. 29, 2000 (JP) ..... 2000-053838

(51) Int. Cl.[7] ..... H05B 3/14

(52) U.S. Cl. ..... 392/407; 219/553; 219/541; 313/110

(58) Field of Search ..... 392/407, 408, 392/422, 432, 424; 219/553, 541, 546, 548, 550; 29/611; 313/110, 113; 362/217

(56) References Cited

U.S. PATENT DOCUMENTS

| | | | | |
|---|---|---|---|---|
| 3,127,112 A | * | 3/1964 | McCammon et al. | 392/422 |
| 5,091,632 A | * | 2/1992 | Hennecke et al. | 219/553 |
| 5,628,859 A | * | 5/1997 | Janin et al. | 156/273.3 |
| 6,041,164 A | * | 3/2000 | Hofius, Sr. et al. | 392/407 |

FOREIGN PATENT DOCUMENTS

| | | | |
|---|---|---|---|
| DE | 4438870 | * | 5/1996 |
| DE | 4438871 | * | 5/1996 |
| GB | 2133259 | * | 7/1984 |
| JP | 57-13681 | | 1/1982 |
| JP | 61-7889 | | 1/1986 |
| JP | 61-53884 | | 4/1986 |
| JP | 62-74779 | | 5/1987 |
| JP | 63-116804 | | 7/1988 |
| JP | 63-45757 | | 11/1988 |
| JP | 64-65790 | | 3/1989 |
| JP | 2-140519 | | 5/1990 |
| JP | 4-324277 | | 11/1992 |
| JP | 7-230795 | | 8/1995 |
| JP | 7-288175 | | 10/1995 |
| JP | 9-42684 | | 2/1997 |
| JP | 11-54092 | | 2/1999 |
| JP | 11-214125 | | 8/1999 |
| JP | 11-214126 | | 8/1999 |
| JP | 2000-228271 | | 8/2000 |

* cited by examiner

*Primary Examiner*—John A. Jeffery
(74) *Attorney, Agent, or Firm*—Pearne & Gordon LLP

(57) ABSTRACT

An infrared ray lamp having a structure wherein a groove is formed in the vicinity of each of both end portions of a substantially plate heating element formed of a carbon-based substance, a carbon-based adhesive is applied to a region including the groove, and the end portion of the heating element is inserted into a slit formed at the end portion of a heat-emitting block having high conductivity so as to be sandwiched; by forming a reflection film on the glass tube of the infrared ray lamp, an infrared ray lamp having a desired emission intensity distribution is provided; a heating apparatus using this infrared ray lamp and method of producing the infrared ray lamp are also provided.

8 Claims, 27 Drawing Sheets

INFRARED LIGHT BULB, HEATING DEVICE, PRODUCTION METHOD FOR INFRARED LIGHT BULB

TECHNICAL FIELD

The present invention relates to an infrared ray lamp to be used for a heater for heating objects and a space heater for heating rooms, etc. (hereinafter referred to as a heating apparatus), more particularly to an infrared ray lamp having good functions as a heat source by using a carbon-based substance as a heating element, to a heating apparatus using the infrared ray lamp, and to a method of producing the infrared ray lamp.

BACKGROUND ART

A conventional infrared ray lamp causes a problem wherein its power consumption increases abnormally after use for a long time, and its heating portions fuse and break in some cases. This problem will be described below.

As an infrared ray lamp conventionally used as a heat source, an infrared ray lamp having a tungsten spiral filament held at the central portion of a glass tube by a number of supports of tungsten is used. However, the infrared ray emission rate of the tungsten is so low as, 30 to 39%, and the rush current at the time of turning on is high. Furthermore, it is necessary to use a number of the tungsten supports for holding the tungsten spiral filament at the central portion of the glass tube, and the assembly work for them was not easy. In particular, sealing the plural tungsten spiral filaments in the glass tube in order to obtain high output was very difficult.

In order to solve these problems, an infrared ray lamp, wherein a carbon-based substance formed into a rod shape is used instead of the tungsten spiral filaments as a heating element, has been proposed conventionally. As such a conventional infrared ray lamp, an infrared ray lamp disclosed in Japanese Published Unexamined Patent Application, Publication No. Hei 11-54092 applied by the same applicant as that of the present invention is available. Since the carbon-based substance has a high infrared ray emission rate of 78 to 84%, the infrared ray emission rate of the infrared ray lamp also becomes high by using the carbon-based substance as a heating element. Furthermore, since the carbon-based substance has a negative resistance temperature characteristic wherein its resistance value lowers as the temperature rises, the carbon-based substance has a significant characteristic of capable of reducing its rush current at the time of turning on.

FIGS. 20 and 21 are front views showing the conventional infrared ray lamp described in Japanese Published Unexamined Patent Application, Publication No. Hei 11-54092, wherein the carbon-based substance is used as a heating element. Part (a) of FIG. 20 is a view showing the structure of the lead wire taking-out portion of the conventional infrared ray lamp in which a heating element 200 is sealed inside a glass tube 100. Part (b) of FIG. 20 is a partially magnified view showing the connection portion between the heating element 200 and the lead wire 104 of the infrared ray lamp shown in the part (a) of FIG. 20. FIG. 21 is a partially magnified view showing the connection portion between the two heating elements 200*a* and 200*b* and the lead wire 104 of the conventional infrared ray lamp in which the two heating elements 200*a* and 200*b* are sealed inside the glass tube. The part (a) of FIG. 20 shows the structure of one end of the infrared ray lamp, and the other end of the infrared ray lamp has similar structure. Furthermore, the structure of the infrared ray lamp shown in FIG. 21 is similar to that shown in the part (a) of FIG. 20, except for the connection portion between the two heating elements 200*a* and 200*b* and the lead wire 104 shown in the figure.

As shown in the part (a) of FIG. 20, in the conventional infrared ray lamp, a metal wire 102 wound in a coil shape is wound around the end of the heating element 200 formed of a carbon-based substance and formed into a rod shape. The end portion of the coil-shaped metal wire 102 is covered with a metal foil sleeve 103, and this metal foil sleeve 103 is secured to the end of the heating element 200 by crimping. The internal lead wire 104 formed of a metal wire and having a coil portion 105 wound in a coil-spring shape in the middle of the wire is electrically bonded to one end of the metal foil sleeve 103. One end of a molybdenum foil sheet 107 is spot-welded to the other end of the internal lead wire 104. Furthermore, an external lead wire 108 formed of a molybdenum wire is welded to the other end of the molybdenum foil sheet 107. The heating element 200, the metal foil sleeve 103, the internal lead wire 104, the molybdenum foil sheet 107 and the external lead wire 108 connected in series as described above are inserted into the glass tube 100 and disposed therein. An inert gas, such as argon, nitrogen or the like, is sealed inside the glass tube 100, the glass tube 100 is fused and bonded at the portion of the molybdenum foil sheet 107, thereby completing an infrared ray lamp.

FIG. 21 is a perspective view showing the inside of another conventional infrared ray lamp and showing the structure of the connection portion between the two heating elements 200*a* and 200*b* and the metal lead wire 104 of the conventional infrared ray lamp. As shown in FIG. 21, this conventional infrared ray lamp has a structure wherein the two heating elements 200*a* and 200*b* are sealed in one glass tube (not shown). In the infrared ray lamp shown in FIG. 21, coil-shaped metal wires 102*a* and 102*b* are wound around the end portions of the heating element 200*a* and 200*b* respectively, and metal foil sleeves 106 are fitted over the wires. The fitted metal foil sleeves 106 are secured to the end portions of the heating elements 200*a* and 200*b* by crimping. The metal lead wire 104 having a coil portion 105 wound in a coil-spring shape in the middle of the wire is electrically connected to the metal foil sleeves 106.

The infrared ray lamps having the above-mentioned structures have good infrared ray emission rates, since their heating elements are formed of a carbon-based substance; but, there are the following problems.

In the conventional infrared ray lamp having the structure shown in FIG. 20, for the lamp of large wattage of the infrared ray lamp, that is, for the lamp of a large power consumption, the coil-shaped metal wire 102 is heated to a high temperature. As a result, when the infrared ray lamp having this structure is used for a long time, the contact resistance of the connection portion among the heating element 200, the coil-shaped metal wire 102 and the metal foil sleeve 103 increases because of the temperature rise. The conventional infrared ray lamp therefore has the problem of abnormal heating at the connection portion. Furthermore, if the temperature at the connection portion between the coil-shaped metal wire 102 and the metal foil sleeve 103 rises continuously for a long time, the temperature at the bonding portion may rise high and, in the worst case, the bonding portion may fuse and break. Moreover, the stress caused by heat cycles due to the difference in thermal expansion coefficient between the heating element 200 and the coil-shaped metal wire 102 is added, and the contact resistance becomes higher than the value at the beginning of use, whereby the temperature rise at the connection portion is accelerated.

In addition, in the structure of the infrared ray lamp having the two heating elements 200*a* and 200*b* shown in FIG. 21, the following problems are caused.

In the process wherein both ends of the two heating elements 200*a* and 200*b* are crimped by using the metal foil sleeve 106, no problem occurs if the two heating elements 200*a* and 200*b* are crimped by a uniform tension or compression force; however, crimping may occur in a state of an unbalanced tension or compression force. In the conventional infrared ray lamp undergone crimping in such away, if the heating elements 200*a* and 200*b* are heated, the two heating elements 200*a* and 200*b* expand thermally in different states. For this reason, the imbalance of the tension or compression force applied to the heating elements 200*a* and 200*b* increases. In the case when the balance in the crimped state is improper in particular, one of the carbon-based heating elements, to which the larger tension or compression force is applied, may break.

Next, the problem of directivity in the conventional infrared ray lamp will be described below.

The infrared ray lamp is used as a heater for heating objects or for a space heater for heating rooms by using radiant infrared rays. As this kind of the conventional infrared ray lamp, an infrared ray lamp having the structure shown in FIG. 22 is known. FIG. 22 is a plan view showing an example of the conventional infrared ray lamp. FIG. 23 is a perspective-view showing the infrared ray lamp shown in FIG. 22. In FIGS. 22 and 23, the central portion of the infrared ray lamp can be understood easily from the descriptions on both side portions shown in the figures, therefore, the central portion of the infrared ray lamp is not shown in either of the figures.

The conventional infrared ray lamp shown in FIGS. 22 and 23 comprises a substantially cylindrical glass tube 201, metal foil sheets 205 embedded in both end portions of the glass tube 201, a heating element 240 hermetically sealed inside the glass tube 201 and internal lead wires 204. The heating element 240 is a resistance wire formed of nichrome or tungsten and wound in a coil shape. The internal lead wires 204 are used to connect both ends of the heating element 240 to the metal foil sheets 205. As a result, the heating element 240 is electrically connected to the metal foil sheets 205 and pulled properly by the internal lead wires 204 on both sides, thereby secured stably. At this time, the center axis of the coil-shaped heating element 240 is disposed so as to be substantially coaxial with the center axis of the cylindrical glass tube 201.

As shown in FIGS. 22 and 23, the external lead wires 206 are connected to the metal foil sheets 205 on both sides respectively. When a voltage is applied across the external lead wires 206 taken out from both sides, a current flows through the heating element 240, and heat generates from the heating element 240 owing to the resistance of the heating element 240 corresponding to the current. At this time, infrared rays are emitted from the heating element 240.

Part (a) of FIG. 24 is a graph of the distribution curve 270 of the intensity of the infrared rays emitted from the heating element 240 of the infrared ray lamp shown in FIG. 23. Part (b) of FIG. 24 is a cross-sectional view showing the portion having the heating element 240 of the infrared ray lamp shown in FIG. 23. The x and y axes shown in the parts (a) and (b) of FIG. 24 are orthogonal coordinate axes on a plane perpendicular to the axial direction of the heating element 240 shown in FIG. 23. In the parts (a) and (b) of FIG. 24, the origin 0 corresponds to the center axis of the heating element 240. In the graph of the part (a) of FIG. 24, the values in the radial directions designate the emission intensity of the infrared rays, and the values in the circumferential directions designate angles with respect to the center axis on the plane perpendicular to the axial direction of the heating element 240. These angles are designated by angles from the positive direction of the x axis.

When a constant voltage was applied to the heating element 240, the amount of the infrared rays reaching a minute area at a constant distance from the center axis (represented by the origin 0 of FIG. 24) of the heating element 240 was measured, whereby the intensity distribution curve 270 was obtained.

As indicated by the intensity distribution curve 270 in the part (a) of FIG. 24, the infrared ray lamp 240 emits infrared rays in all directions at substantially similar intensity. This results from the fact that the cross-sectional shape of the heating element 240 is substantially symmetrical with respect to its axis and has a circular shape as shown in the part (b) of FIG. 24.

By the equally distributed infrared rays emitted in all directions at substantially similar intensity as described above, heat is transmitted from the heating element 240 to the outside and used to heat the outside and the surroundings.

In the conventional infrared ray lamp structured as described above, in the case when it is desired to give directivity to the emission intensity of the infrared rays, a structure is known wherein an infrared ray reflection plate is installed outside the infrared ray lamp for example.

FIG. 25 is a perspective view showing an example wherein an infrared ray reflection plate 280 is provided for the conventional infrared ray lamp and showing the positional relationship between the infrared ray lamp and the infrared ray reflection plate 280. The infrared ray reflection plate 280 has a semi-cylindrical shape and is disposed coaxially with the heating element 240 so as to surround the half of the heating element 240.

Part (a) of FIG. 26 is a graph of the distribution curve 271 of the intensity of the infrared rays emitted from the infrared ray lamp having the infrared ray reflection plate 280. Part (b) of FIG. 26 is a cross-sectional view showing the portion having the heating element 240 of the infrared ray lamp having the infrared ray reflection plate 280 shown in FIG. 25. The x and y axes shown in the parts (a) and (b) of FIG. 26 are orthogonal coordinate axes on a plane perpendicular to the axial direction of the heating element 240 shown in FIG. 25. The direction opposed to the reflection face of the infrared ray reflection plate 280 is defined as the negative direction of the x axis. In the parts (a) and (b) of FIG. 26, the origin 0 corresponds to the center axis of the heating element 240. In the graph of the part (a) of FIG. 26, the values in the radial directions represented the emission intensity of the infrared rays, and the values in the circumferential directions represented angles with respect to the center axis on the plane perpendicular to the axial direction of the heating element 240. These angles are designated by angles from the positive direction of the x axis. In the part (a) of FIG. 26, the concentric gradations indicating the emission intensity have the same values of the gradations shown in the part (a) of the above-mentioned FIG. 24. In addition, the method of measuring the emission intensity is the same as that in the case shown in the part (a) of FIG. 24.

As shown in the part (a) of FIG. 26, by providing the infrared ray reflection plate 280, infrared rays are emitted intensely only on one side of the infrared ray lamp, with the positive direction of the x axis used as the center.

As described above, in the conventional infrared ray lamp, it is indicated that the emission of the infrared rays has isotropic intensity distribution in all directions. For this reason, in order to give directivity to infrared ray emission, it is necessary to provide the infrared ray reflection plate outside the infrared ray lamp.

However, the infrared ray reflectivity of the infrared ray reflection plate is apt to be lowered because of aging and the adhesion of stains. As a result, the intensity distribution of the infrared ray emission becomes different with the direction of the emission. Furthermore, as the infrared ray reflectivity lowers, the amount of the infrared rays absorbed by the reflection plate itself increases. If this kind of heating apparatus is used for a long time, emission efficiency lowers, and unexpected parts will be overheated.

Furthermore, the emission intensity distribution obtained by providing the semi-cylindrical infrared ray reflection plate for the infrared ray lamp having the above-mentioned isotropic emission intensity distributions in all directions is substantially the same in a wide range on one side in general as shown in the part (a) of FIG. 26. For this reason, in the conventional infrared ray lamp, an attempt to increase the emission intensity in a more limited range and to decrease the intensity in other ranges in order to enhance directivity is difficult. As a result, in the case when the conventional heating apparatus is used for localized heating, the problem of low heating efficiency occurs.

DISCLOSURE OF INVENTION

The present invention is intended to solve the above-mentioned problems and also intended to provide a highly reliable infrared ray lamp wherein its power consumption does not increase during use for a long time and its heating portions are prevented from fusing and breaking after use for a long time. The present invention is further intended to make the effect of the reduction of the reflectivity of an infrared ray reflection plate on the directional distribution of the emission intensity of infrared rays lower than that of the conventional infrared ray lamp, and to make the directivity of the emission intensity of infrared rays higher than that of the conventional infrared ray lamp. The present invention provides an infrared ray lamp and a heating apparatus wherein the emission intensity of infrared rays has directivity without using any reflection plate, and also provides a method of producing the infrared ray lamp.

An infrared ray lamp in accordance with the present invention comprises:

- at least one heating element having a substantially plate shape, having recessed portions in the vicinities of both ends thereof and formed of a carbon-based substance,
- heat-emitting blocks having good conductivity to which both end portions of the heating element are inserted and bonded,
- a sintered substance of an adhesive formed and sintered on the insertion and bonding faces of the heating element bonded to the heat-emitting blocks at the regions in the vicinities of both end portions of the heating element including the recessed portions thereof,
- a glass tube in which the heating element, the sintered substance of the adhesive and the heat-emitting blocks are hermetically sealed together with an inert gas, and
- lead wires electrically connected to the heat-emitting blocks, the end portions of which are led, out of the glass tube.

With this structure, in the infrared ray lamp, the recessed portions are provided in the vicinities of both ends of the carbon-based substance used as the heating element, and the areas of the contact with the heat-emitting blocks via the carbon-based adhesive are increased, whereby the resistance of the contact can be reduced, heating due to the resistance of the contact can be restricted, and the temperatures of the lead wire installation portions at both end portions can be prevented from becoming locally high. As a result, according to the present invention, it is possible to prevent the lead wire installation portions from fusing and breaking owing to the temperature rise at the portions. In addition, since the recessed portions in the vicinities of both ends of the heating element are filled with the carbon-based adhesive, the fitting or bonding between the heating element and the heat-emitting blocks becomes closer, and the strength of the bonding is enhanced. As a result, in the infrared ray lamp of the present invention, stress due to heat can be absorbed, and abnormal heating can be prevented.

An infrared ray lamp from another viewpoint in accordance with the present invention comprises:

- at least one heating element having a substantially plate shape, having recessed portions in the vicinities of both ends thereof and formed of a carbon-based substance,
- heat-emitting blocks having good conductivity and each split into two pieces, between which both end portions of the heating element are sandwiched,
- a sintered substance of an adhesive formed and sintered on the insertion and bonding faces of the heating element bonded to the heat-emitting blocks at the regions in the vicinities of both end portions of the heating element including the recessed portions thereof,
- a glass tube in which the heating element, the sintered substance of the adhesive and the heat-emitting blocks are hermetically sealed together with an inert gas, and
- lead wires electrically connected to the heat-emitting blocks, the end portions of which are taken outside the glass tube.

With this structure, in the infrared ray lamp, the heating element is bonded to the heat-emitting blocks by pressure contact; then, since accurate disposition at predetermined positions for fitting is not required, assembly work can be carried out easily, and the cost of production can be reduced significantly.

Method of producing an infrared ray lamp in accordance with the present invention comprises:

- a step of forming recessed portions in the vicinities of both ends of at least one heating element having a substantially plate shape and formed of a carbon-based substance,
- a step of applying a liquid adhesive formed of a carbon-based organic substance to the regions in the vicinities of both ends of the heating element including the recessed portions thereof,
- a step of inserting and bonding both end portions of the heating element to the end portions of heat-emitting blocks having good conductivity by using the adhesive,
- a step of drying and firing the heat-emitting blocks and the heating element bonded to each other, and
- a step of sealing the heating element and the heat-emitting blocks inside the glass tube together with an inert gas, and of taking the end portions of the lead wires electrically connected to the heat-emitting blocks outside the glass tube.

With these steps, the infrared ray lamp has high reliability by not raising its power consumption abnormally during use for a long time and by preventing its heating portions from fusing and breaking after use for a long time.

An infrared ray lamp from another viewpoint in accordance with the present invention comprises:

a heating element having a substantially plate shape, the width of which is larger than its thickness by five times or more, a glass tube in which the heating element is hermetically sealed, and two electrodes embedded at both end portions of the glass tube, electrically connected to both ends of the heating element respectively and also electrically connected to an external electric circuit.

With this structure, the emission intensity of the infrared ray lamp becomes a maximum value in the thickness direction of the heating element and becomes negligibly small in comparison with the maximum value in the width direction.

A heating apparatus in accordance with the present invention comprises:

a heating element having a substantially plate shape, the width of which is larger than its thickness by five times or more, a glass tube in which the heating element is hermetically sealed, and two electrodes embedded at both end portions of the glass tube, electrically connected to both ends of the heating element respectively and also electrically connected to an external electric circuit.

With this structure, the emission intensity of the infrared ray lamp in the heating apparatus becomes a maximum value in the thickness direction of the heating element and becomes negligibly small in comparison with the maximum value in the width direction, thereby having directivity.

A method of producing an infrared ray lamp from another viewpoint of the present invention compromises:

a step of forming a glass tube by forming glass into a substantially cylindrical shape, a step of hermetically sealing a substantially plate heating element, the width of which is larger than its thickness by five times or more, in the glass tube so that the center line of the heating element in the longitudinal direction thereof is substantially coaxial with the center axis of the glass tube, and a step of forming a reflection film for reflecting infrared rays into a substantially semi-cylindrical shape on the external face of the cylindrical shape of the glass tube so as to substantially include the range of the disposition of the heating element in the axial direction thereof.

With this structure, the semi-cylindrical reflection film can be formed easily by using the cylindrical shape of the glass tube.

A method of producing an infrared ray lamp from still another viewpoint of the present invention compromises:

a step of forming a glass tube by forming glass into a substantially cylindrical shape, a step of forming a reflection film for reflecting infrared rays into a predetermined substantially semi-cylindrical shape on the external face or the internal face of the cylindrical shape of the glass tube, and a step of disposing a substantially plate heating element, the width of which is larger than its thickness by five times or more, so as to be included in the axial range wherein the reflection film is disposed, and of hermetically sealing the heating element inside the glass tube.

With this structure, the semi-cylindrical reflection film can be formed easily even on the internal face of the glass tube by using the cylindrical shape of the glass tube.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF DRAWINGS

FIG. 1(*a*) is a front view showing the end portions of an alternative embodiment of the infrared ray lamp of FIG. 1 wherein two external lead wires are provided at each end;

Figure 9A:
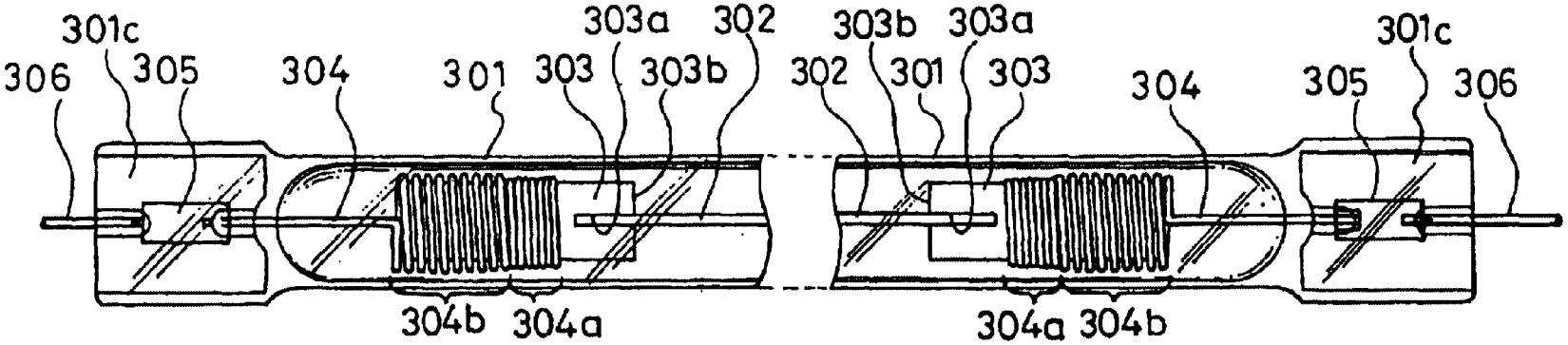
Figure 9B:
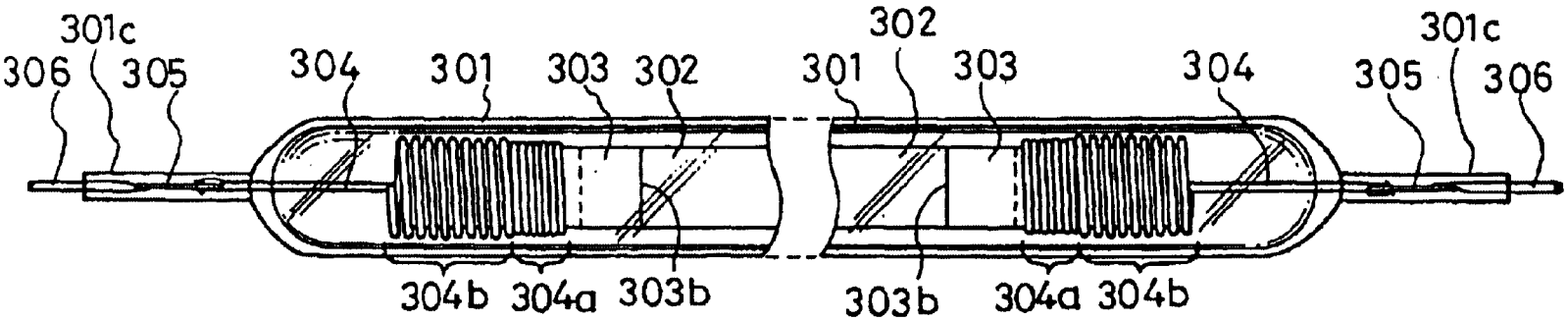
Figure 10:
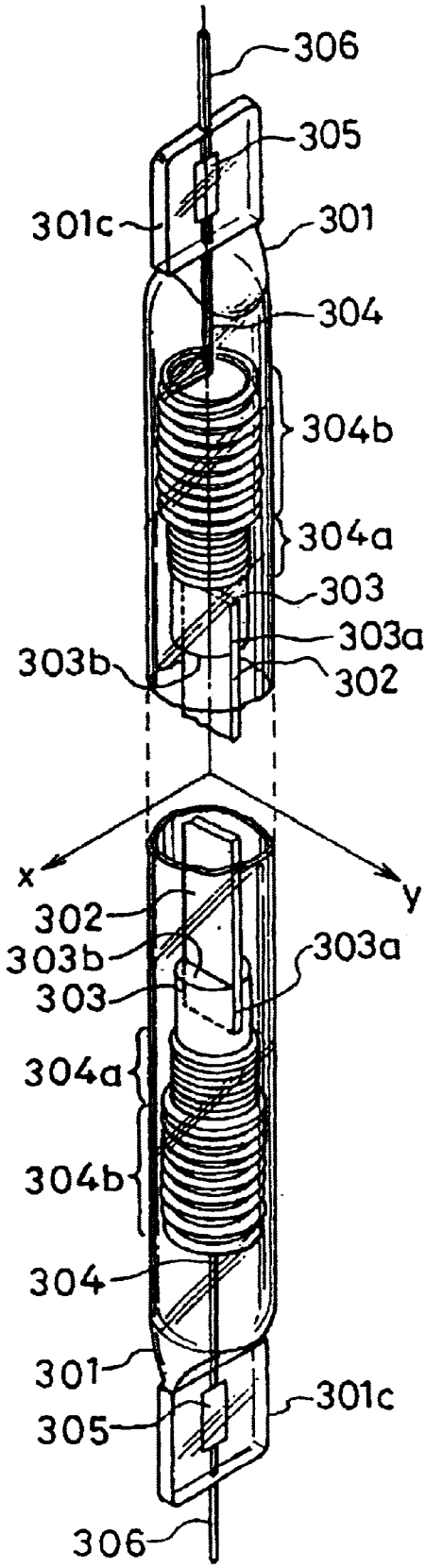
Figure 11A:
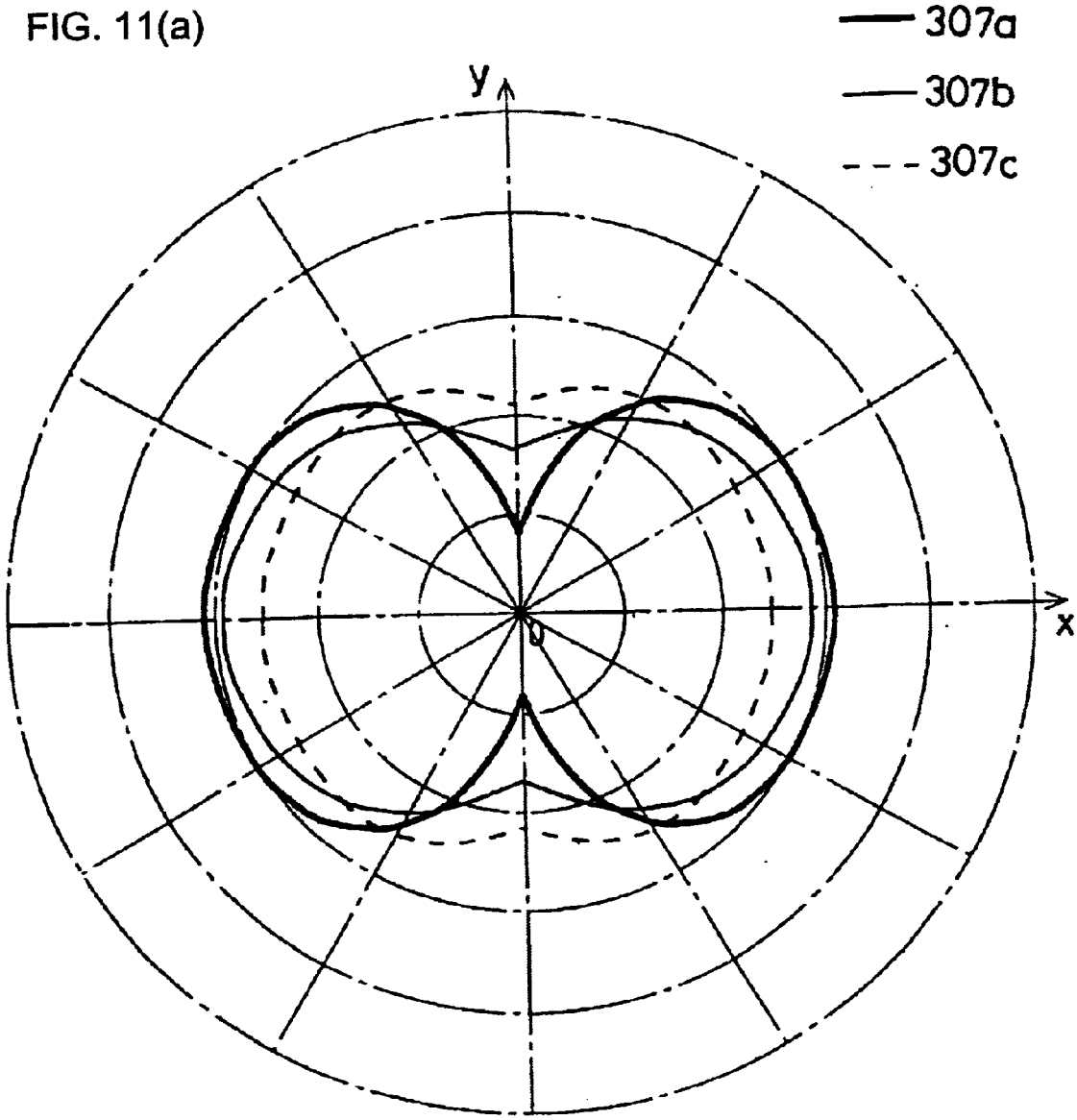
Figure 11B:
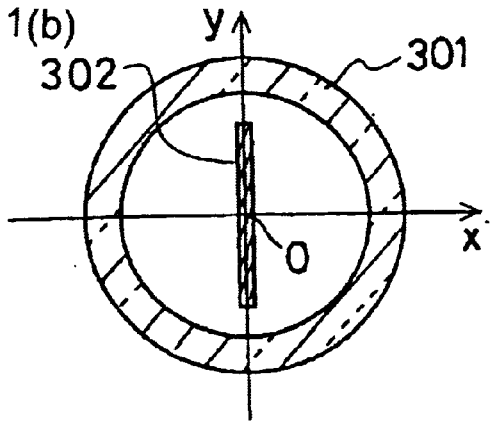
Figure 12A:
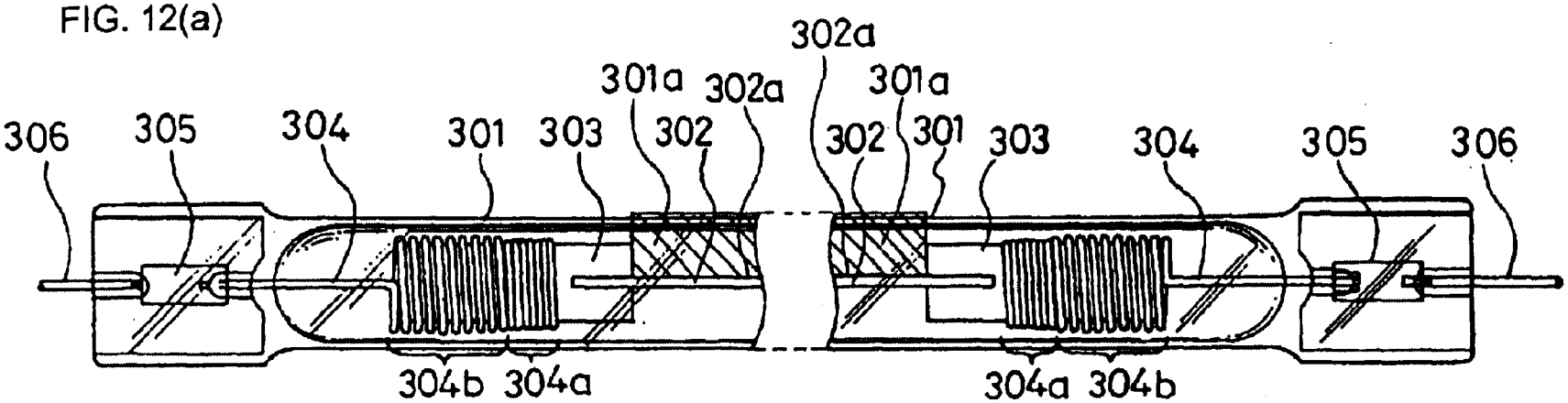
Figure 12B:
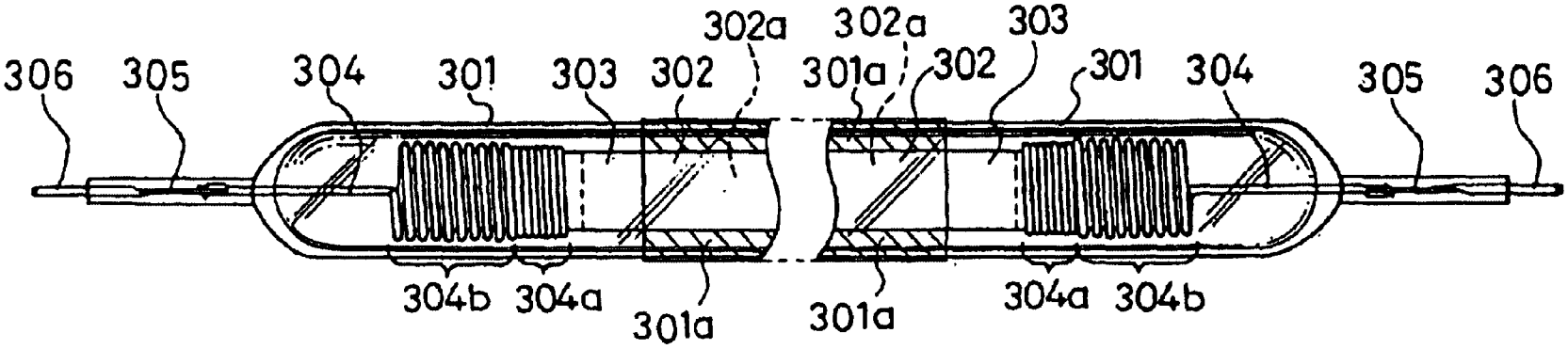
Figure 13:
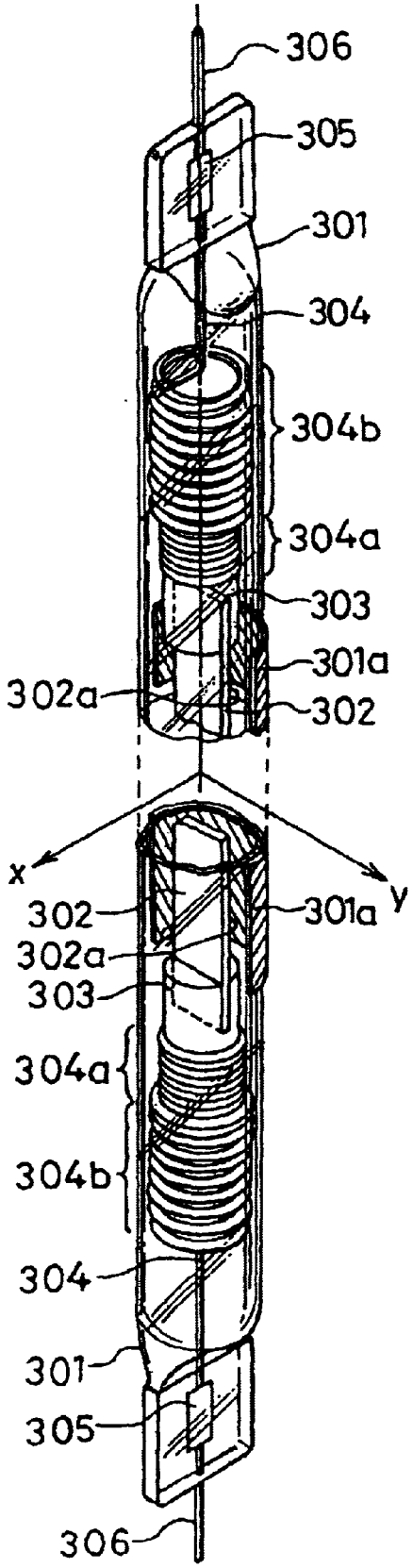
Figure 14A:
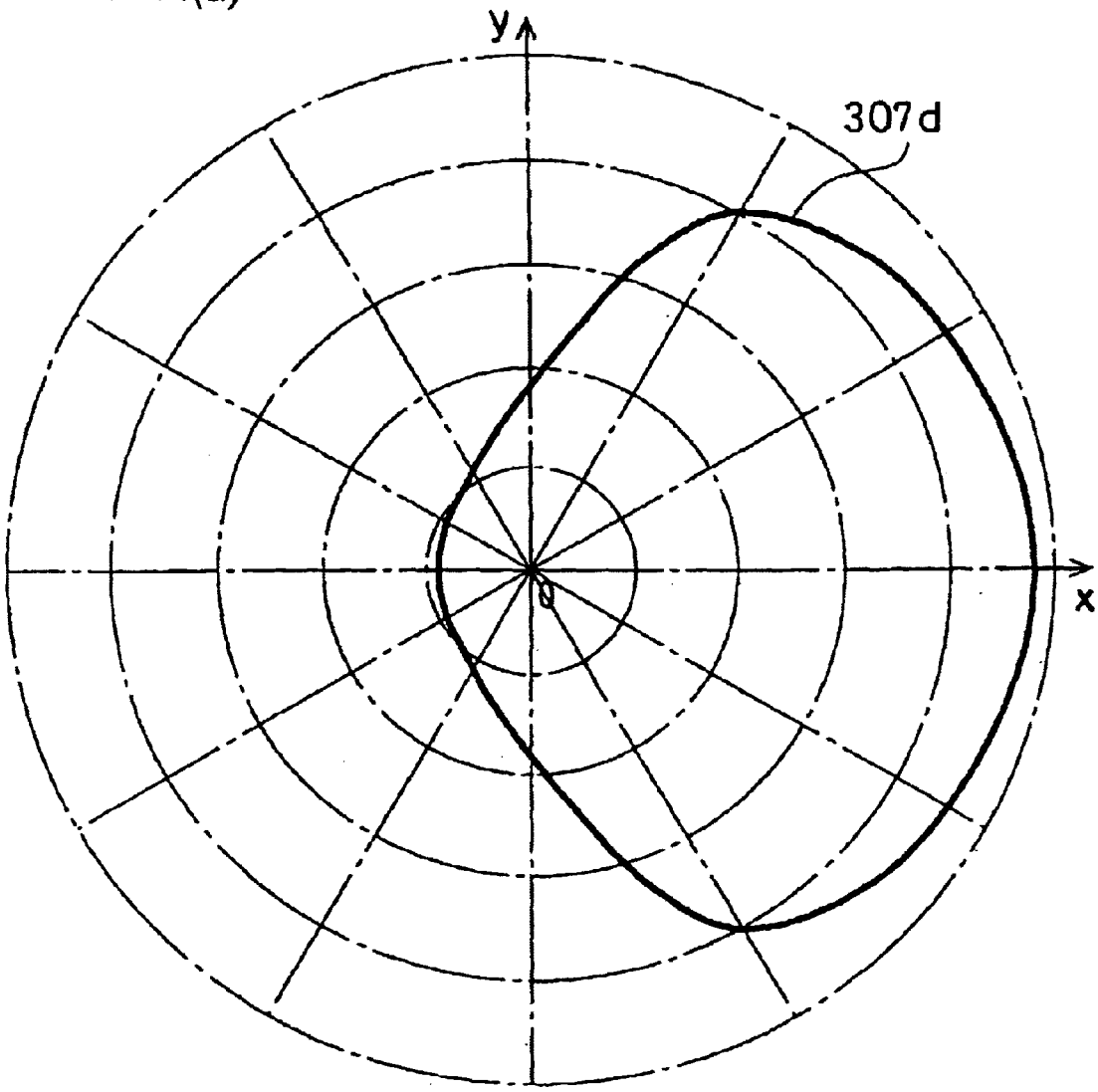
Figure 14B:
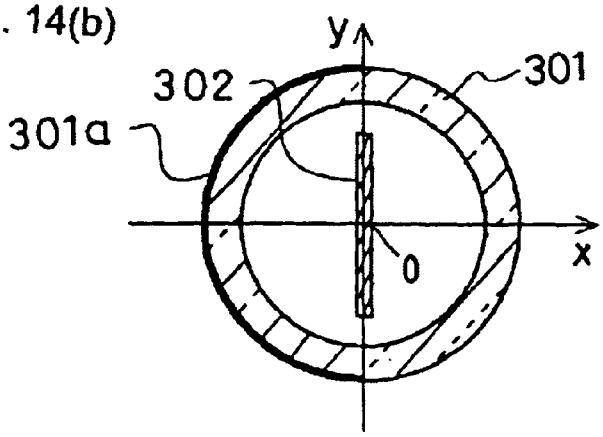
Figure 15A:
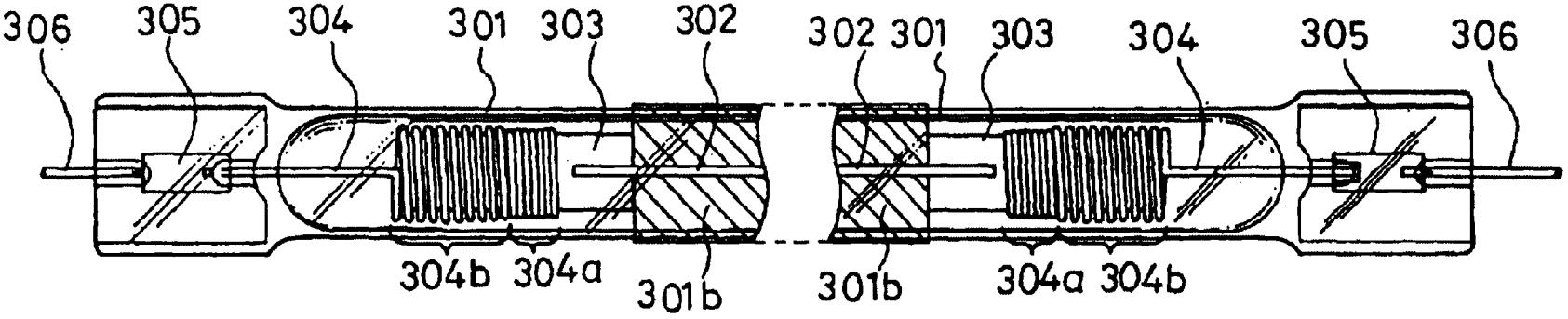
Figure 15B:
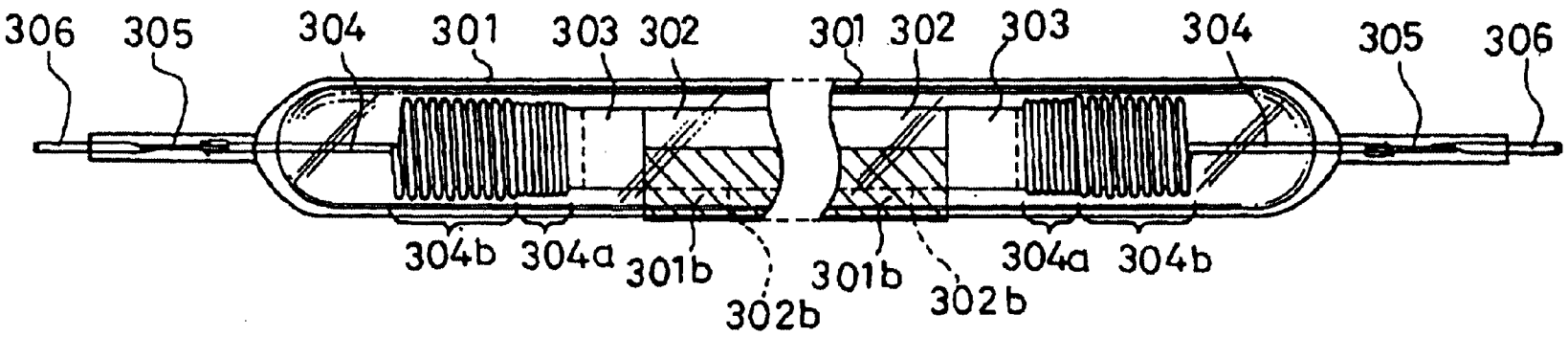
Figure 16:
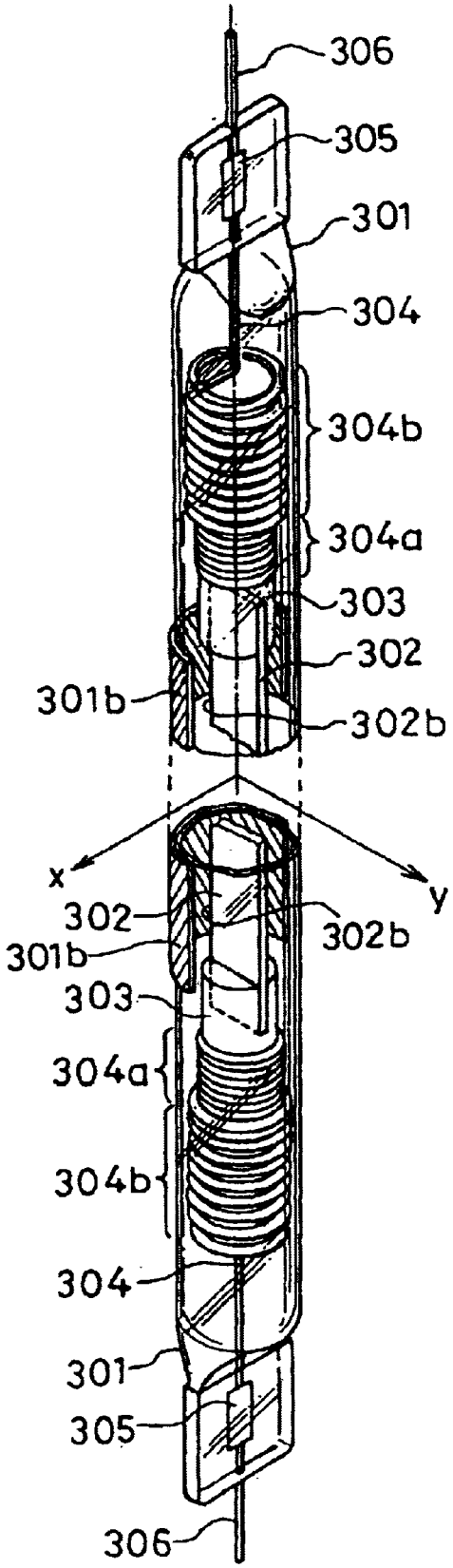
Figure 17A:
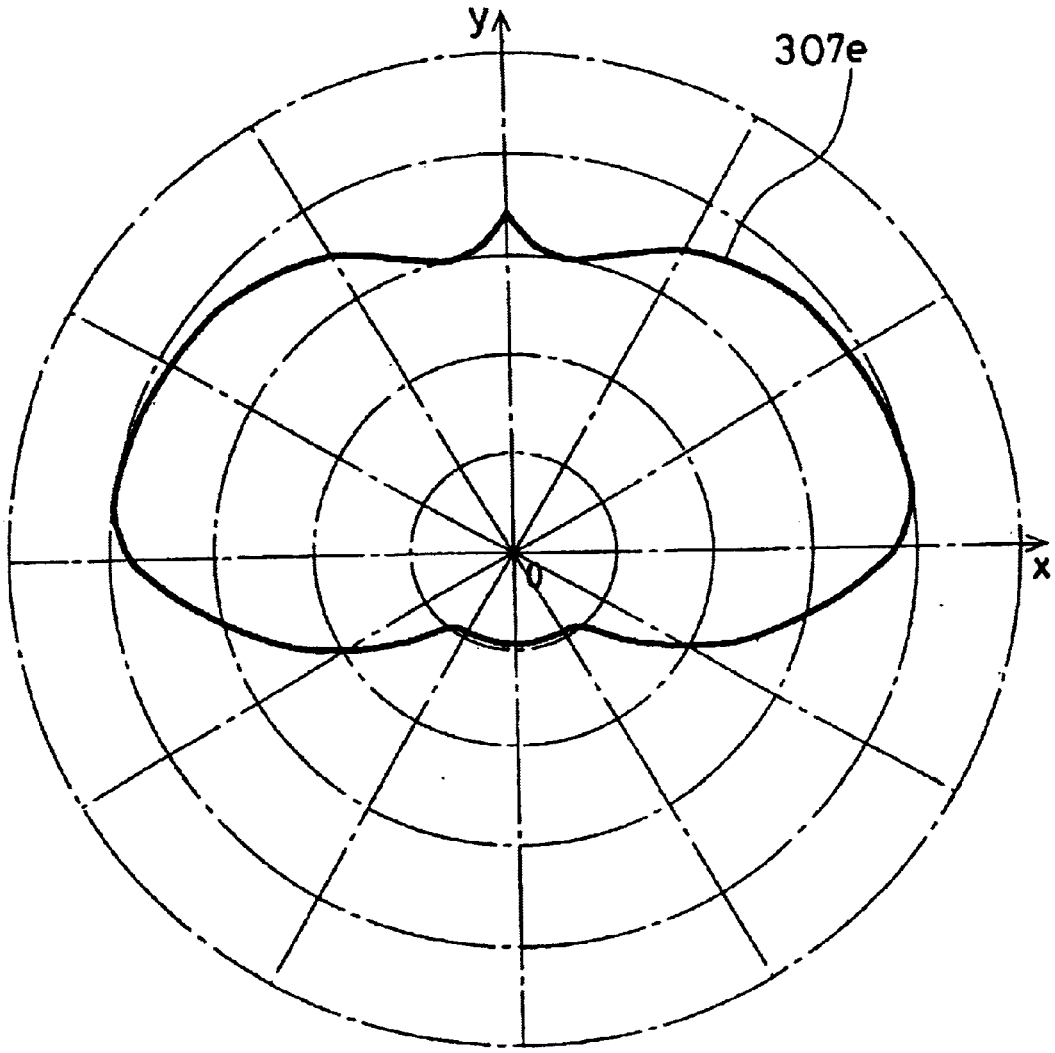
Figure 17B:
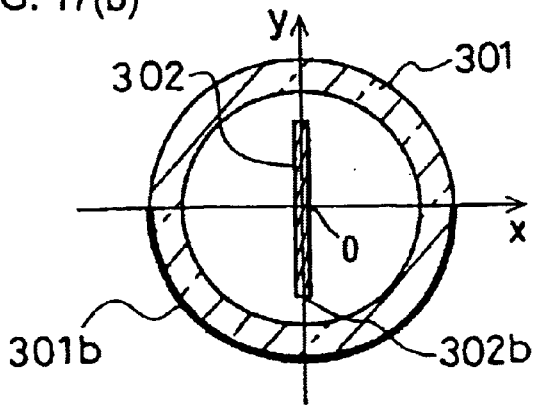
Figure 18:
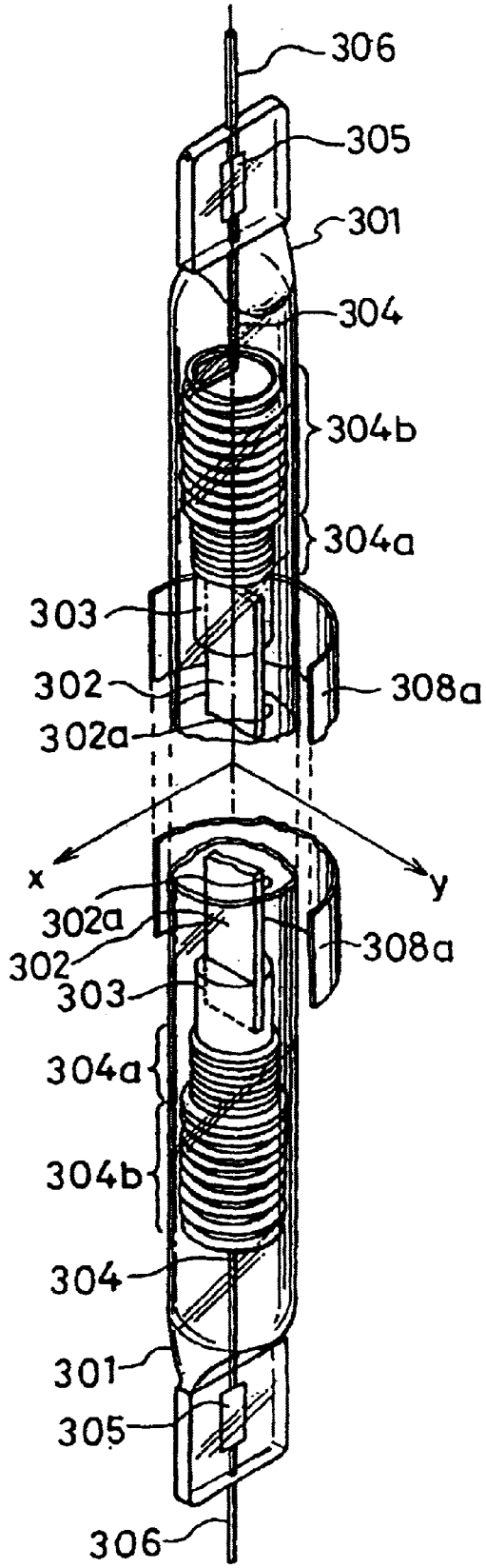
Figure 19:
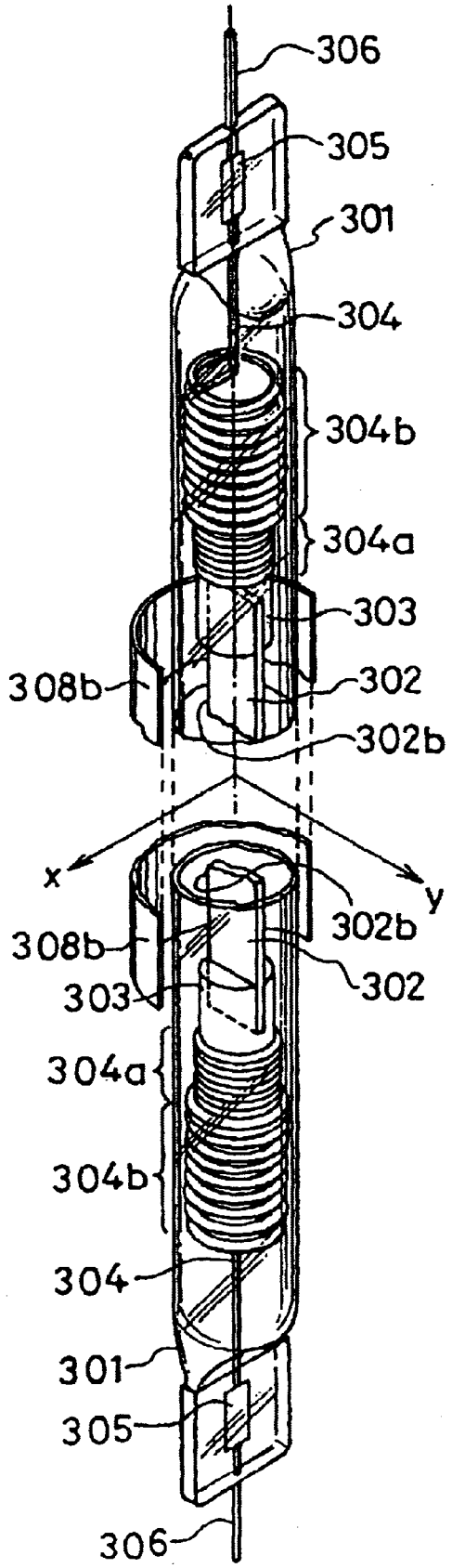
Figure 20A:
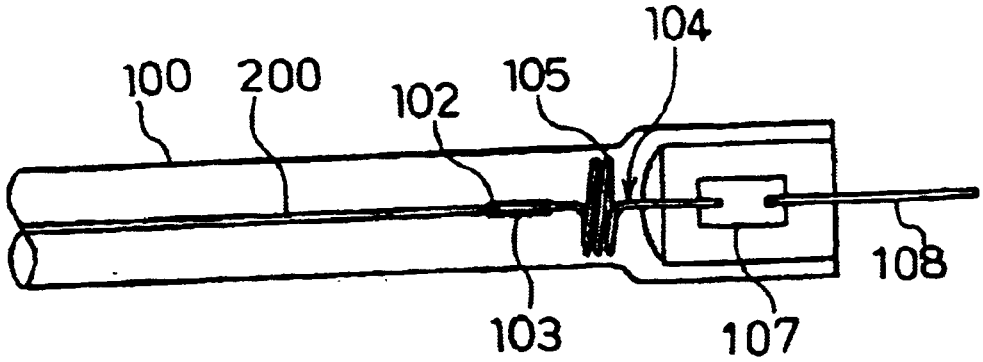
FIG. 20(a) PRIOR ART
Figure 20B:
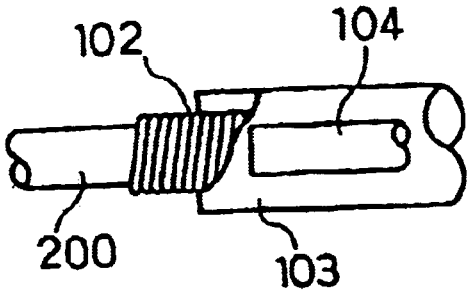
FIG. 20(b) PRIOR ART
Figure 21:
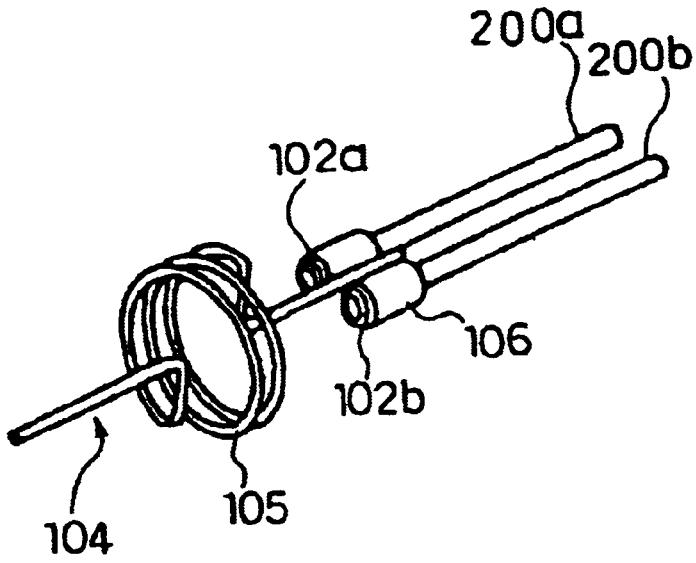
FIG. 21 PRIOR ART
Figure 22:
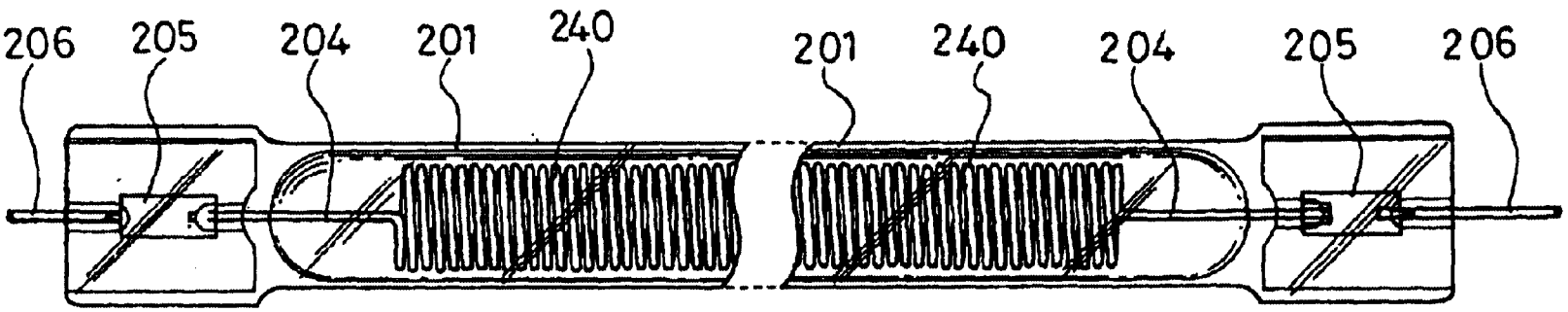
FIG. 22 PRIOR ART
Figure 23:
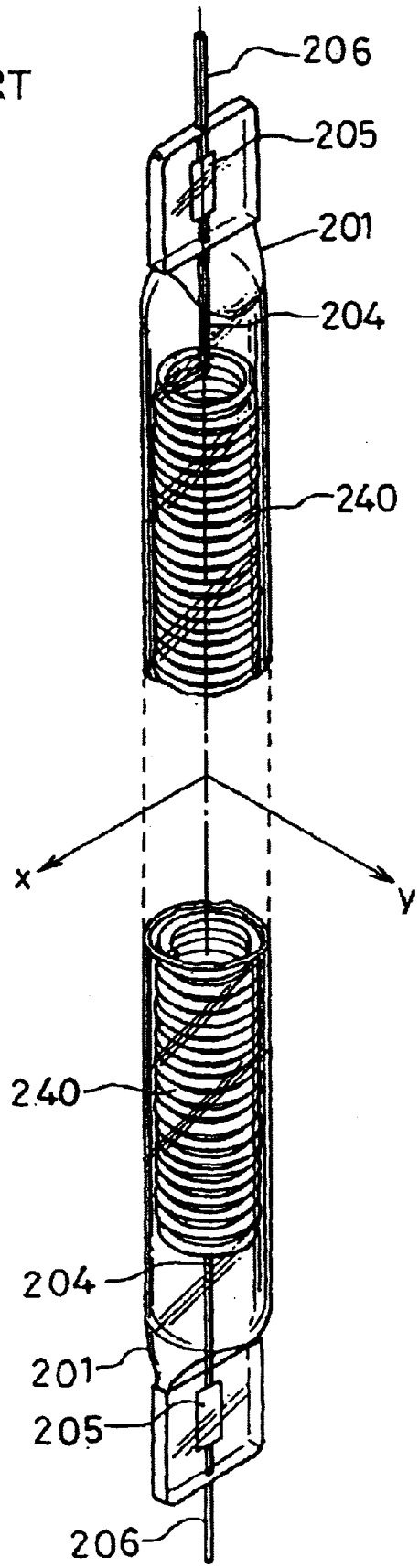
FIG. 23 PRIOR ART
Figure 24A:
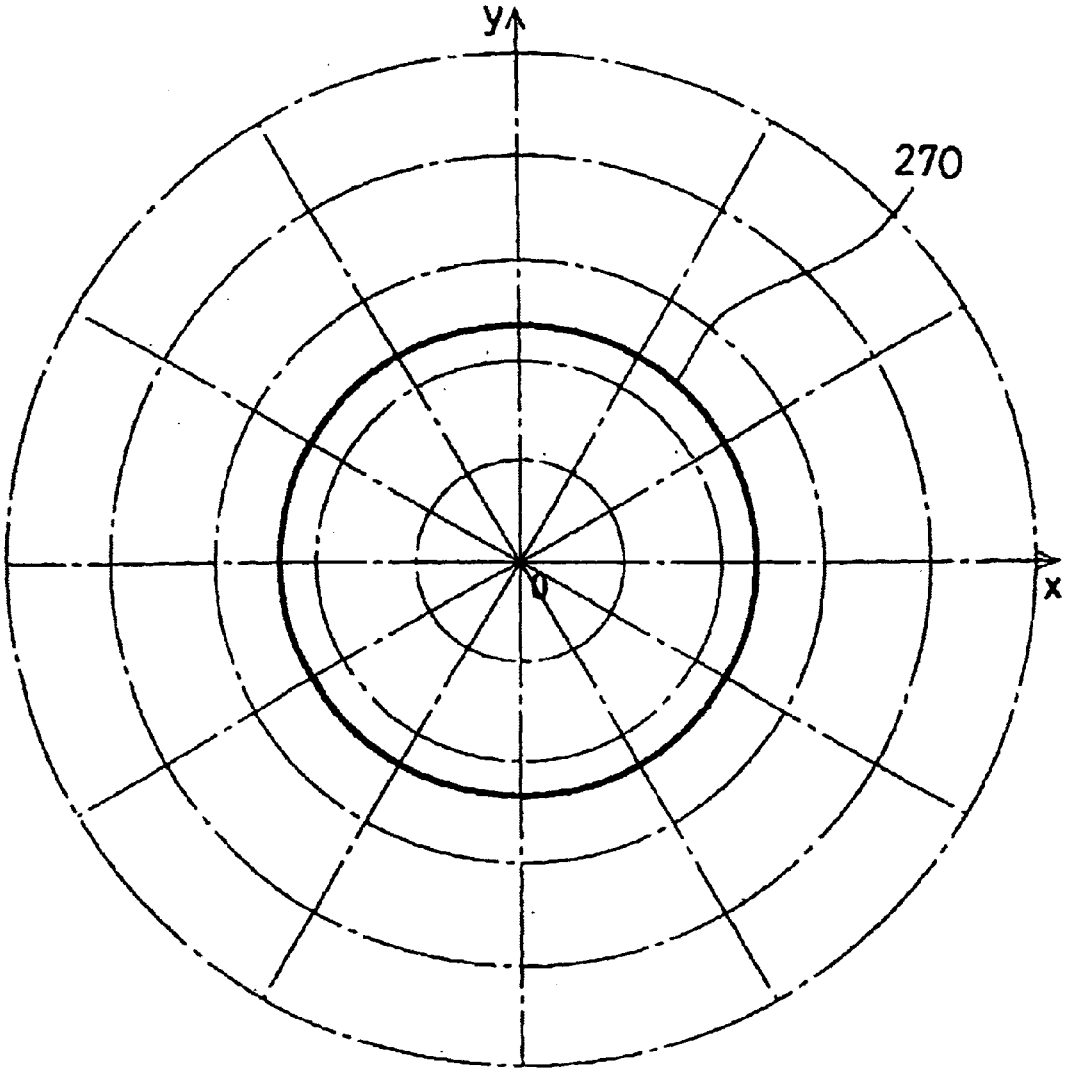
FIG. 24(a) PRIOR ART
Figure 24B:
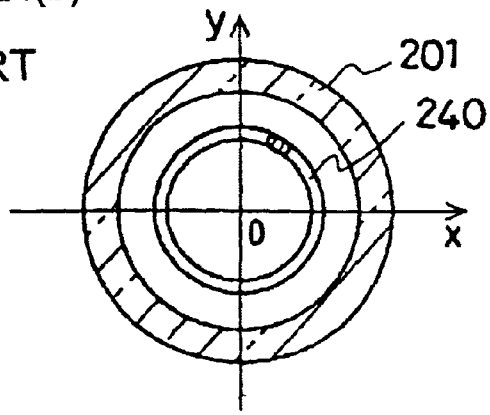
FIG. 24(b) PRIOR ART
Figure 25:
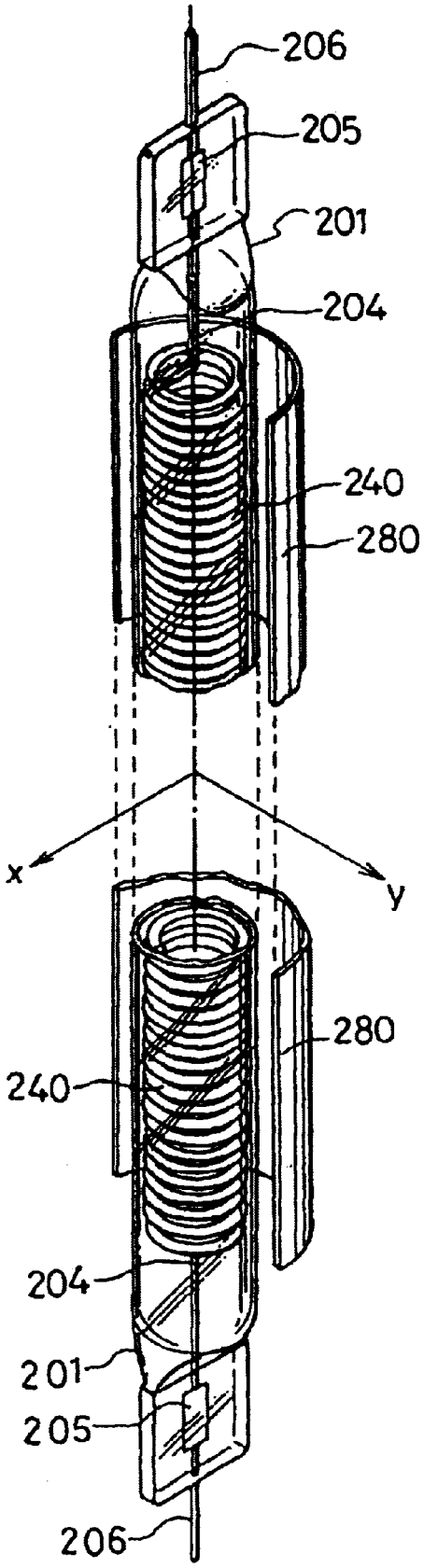
FIG. 25 PRIOR ART
Figure 26A:
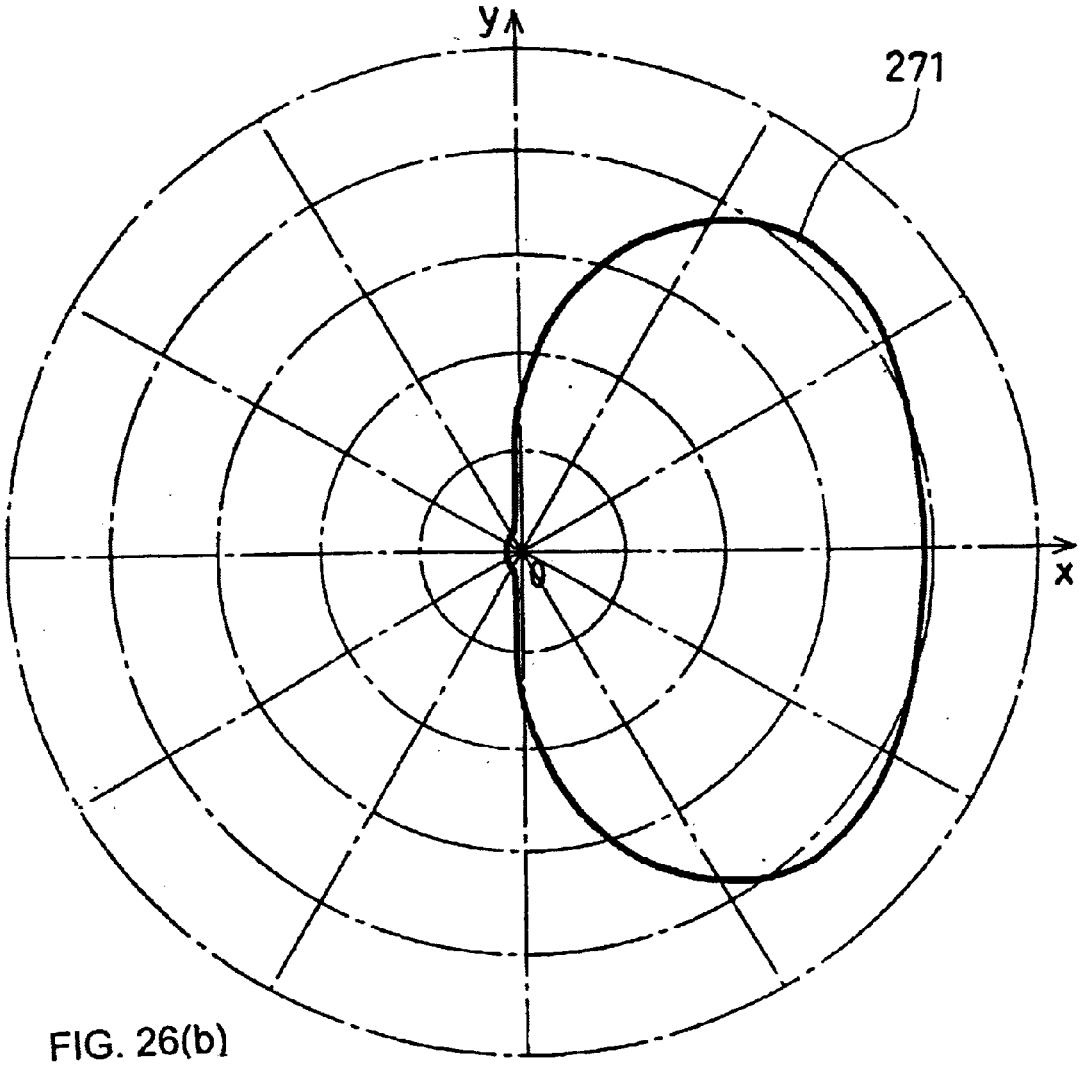
FIG. 26(a) PRIOR ART
Figure 26B:
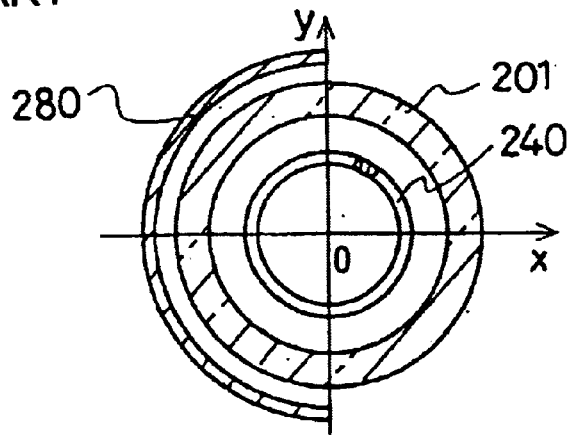
FIG. 26(b) PRIOR ART

part (a) of FIG. 9 is a plan view showing an infrared ray lamp in accordance with a third embodiment of the present invention, and part (b) of FIG. 9 is a front view thereof;

FIG. 10 is a perspective view showing the infrared ray lamp in accordance with the third embodiment of the present invention;

part (a) of FIG. 11 is a graph showing the distribution curve of the intensity of the infrared rays emitted from the heating element of the third embodiment, and part (b) of FIG. 11 shows the cross section of the central portion of the infrared ray lamp of the third embodiment;

part (a) of FIG. 12 is a plan view showing an infrared ray lamp in accordance with a fourth embodiment of the present invention, and part (b) of FIG. 12 is a front view thereof;

FIG. 13 is a perspective view showing the infrared ray lamp in accordance with the fourth embodiment of the present invention;

part (a) of FIG. 14 is a graph showing the distribution curve of the intensity of the infrared rays emitted from the infrared ray lamp of the fourth embodiment, and part (b) of FIG. 14 shows the cross section of the central portion of the infrared ray lamp of the fourth embodiment;

part (a) of FIG. 15 is a plan view showing an infrared ray lamp in accordance with a fifth embodiment of the present invention, and part (b) of FIG. 15 is a front view thereof;

FIG. 16 is a perspective view showing the infrared ray lamp in accordance with the fifth embodiment of the present invention;

part (a) of FIG. 17 is a graph showing the distribution curve of the intensity of the infrared rays emitted from the infrared ray lamp of the fifth embodiment, and part (b) of FIG. 17 shows the cross section of the central portion of the infrared ray lamp of the fifth embodiment;

FIG. 18 is a perspective view showing the positional relationship between the infrared ray lamp and the infrared ray reflection plate of a heating apparatus in accordance with a sixth embodiment of the present invention;

FIG. 19 is a perspective view showing the positional relationship between the infrared ray lamp and the infrared ray reflection plate of a heating apparatus in accordance with a seventh embodiment of the present invention;

FIG. 20 is a partial view showing the structure of the lead wire taking-out portion of a conventional infrared ray lamp;

FIG. 21 is a partial view showing the structure of the lead wire taking-out portion of a conventional infrared ray lamp wherein two heating elements are sealed in a glass tube;

FIG. 22 is a plan view showing a conventional infrared ray lamp;

FIG. 23 is a perspective view showing the conventional infrared ray lamp;

part (a) of FIG. 24 is a graph showing the distribution curve of the intensity of the infrared rays emitted from the heating element of the conventional infrared ray lamp, and part (b) of FIG. 24 shows the cross section of the central portion of the infrared ray lamp shown in FIG. 23;

FIG. 25 is a perspective view showing the positional relationship between the infrared ray reflection plate and the infrared ray lamp in the conventional infrared ray lamp; and part (a) of FIG. 26 is a graph showing the distribution curve of the intensity of the infrared rays emitted from the conventional infrared ray lamp provided with an infrared ray reflection plate shown in FIG. 25, and part (b) of FIG. 26 shows the cross section of the central portion of the infrared ray lamp shown in FIG. 25.

It will be recognized that some or all of the Figures are schematic representations for purposes of illustration and do not necessarily depict the actual relative sizes or locations of the elements shown.

BEST MODE FOR CARRYING OUT THE INVENTION

Preferred embodiments of an infrared ray lamp and an infrared heating apparatus in accordance with the present invention will be described below referring to the accompanying drawings.

First Embodiment

Figure 1:
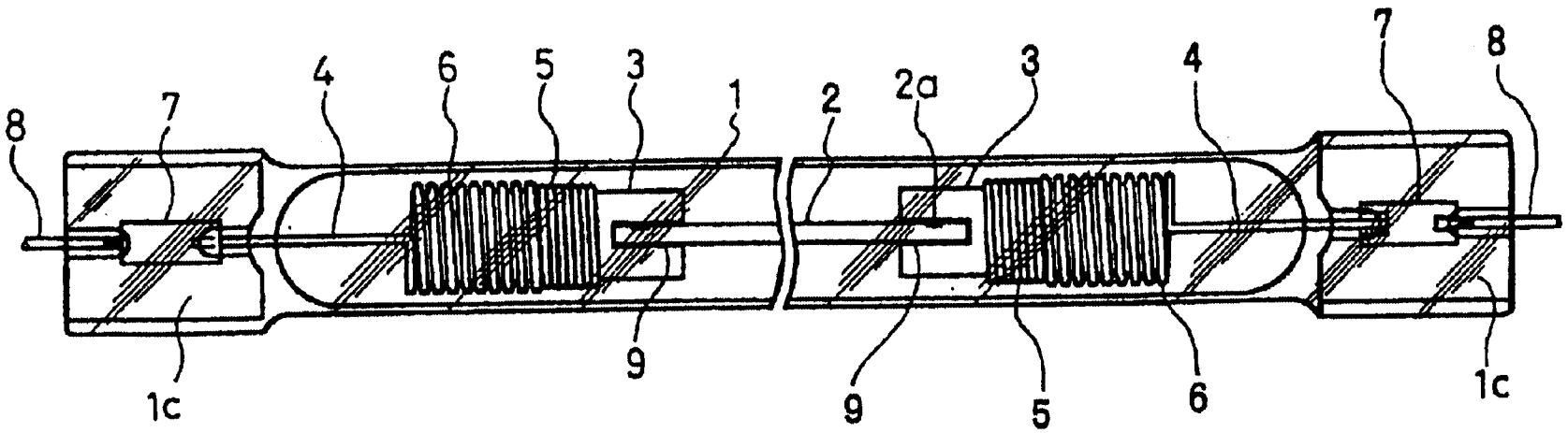
FIG. 1 is a front view showing the structure of the lead wire taking-out portion of an infrared ray lamp in accordance with a first embodiment of the present invention.
Figure 1A:
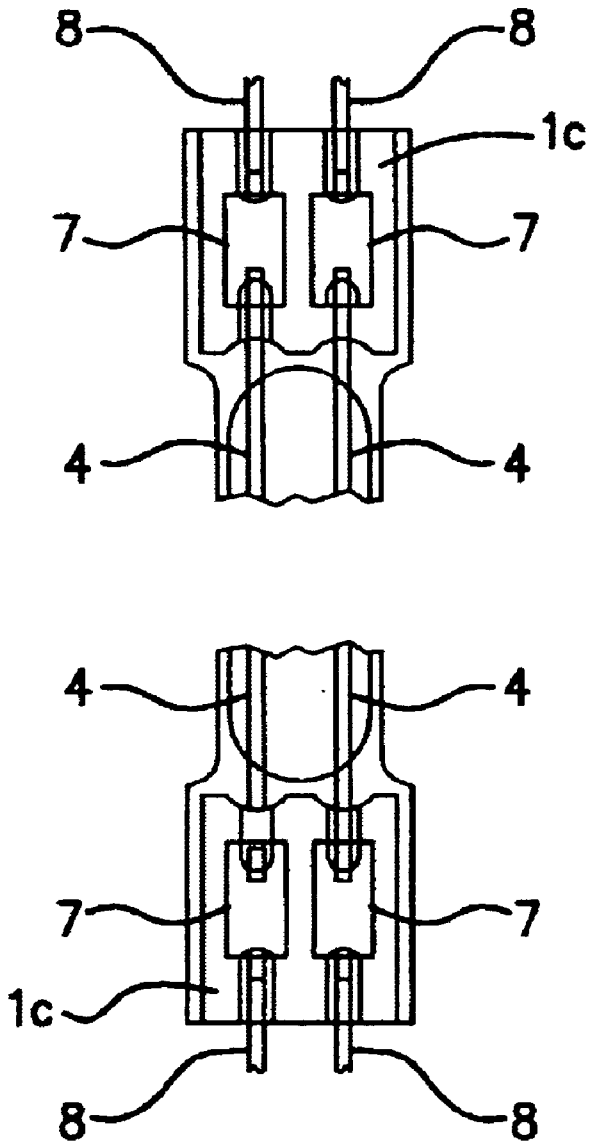

FIG. 1 is a front view showing the structure of an infrared ray lamp in accordance with a first embodiment of the present invention, and shows the structure of the lead wire taking-out portions of the infrared ray lamp. FIG. 1 shows both end portions of the infrared ray lamp of the first embodiment. Since its central portion has a continuous structure connecting both end portions, the central portion is not shown.

As shown in FIG. 1, in the infrared ray lamp of the first embodiment, a heating element 2, heat-emitting blocks 3 and internal lead wires 4 are sealed in a glass tube 1. Alternatively, as shown in FIG. 1(*a*), two or more external lead wires 8 can be provided as electrodes at each end of the tube 1. The internal lead wire 4 is connected to an external lead wire 8 via a molybdenum foil sheet 7. The plate heating element 2 sealed in the glass tube 1 is formed of a carbon-based substance consisting of a mixture of crystallized carbon such as graphite, a resistance value adjustment substance and amorphous carbon. This heating element 2 has a plate shape measuring 6 mm in width, 0.5 mm in thickness and 300 mm in length for example. The heat-emitting block 3 is formed of a conductive material and electrically connected to one end of the heating element 2 by a method described later. A coil portion 5 is formed at one end of the internal lead wire 4, and a spring portion 6 having elasticity is formed following the coil portion 5.

As shown in FIG. 1, the coil portion 5 of the internal lead wire 4 is wound tightly on the outer peripheral face of the heat-emitting block 3 so as to be electrically connected thereto. The spring portion 6 of the internal lead wire 4 is disposed away from the outer peripheral face of the heat-emitting block 3 by a predetermined distance and is structured to expand and contract so that the dimensional change of the heating element 2 due to its expansion can be canceled and absorbed.

At the sealing portion 1*c* of the infrared ray lamp of the first embodiment, the internal lead wire 4 inside the glass tube 1 is connected to one end of the molybdenum foil sheet 7, and the other end of the molybdenum foil sheet 7 is connected to the external lead wire 8.

Figure 2:
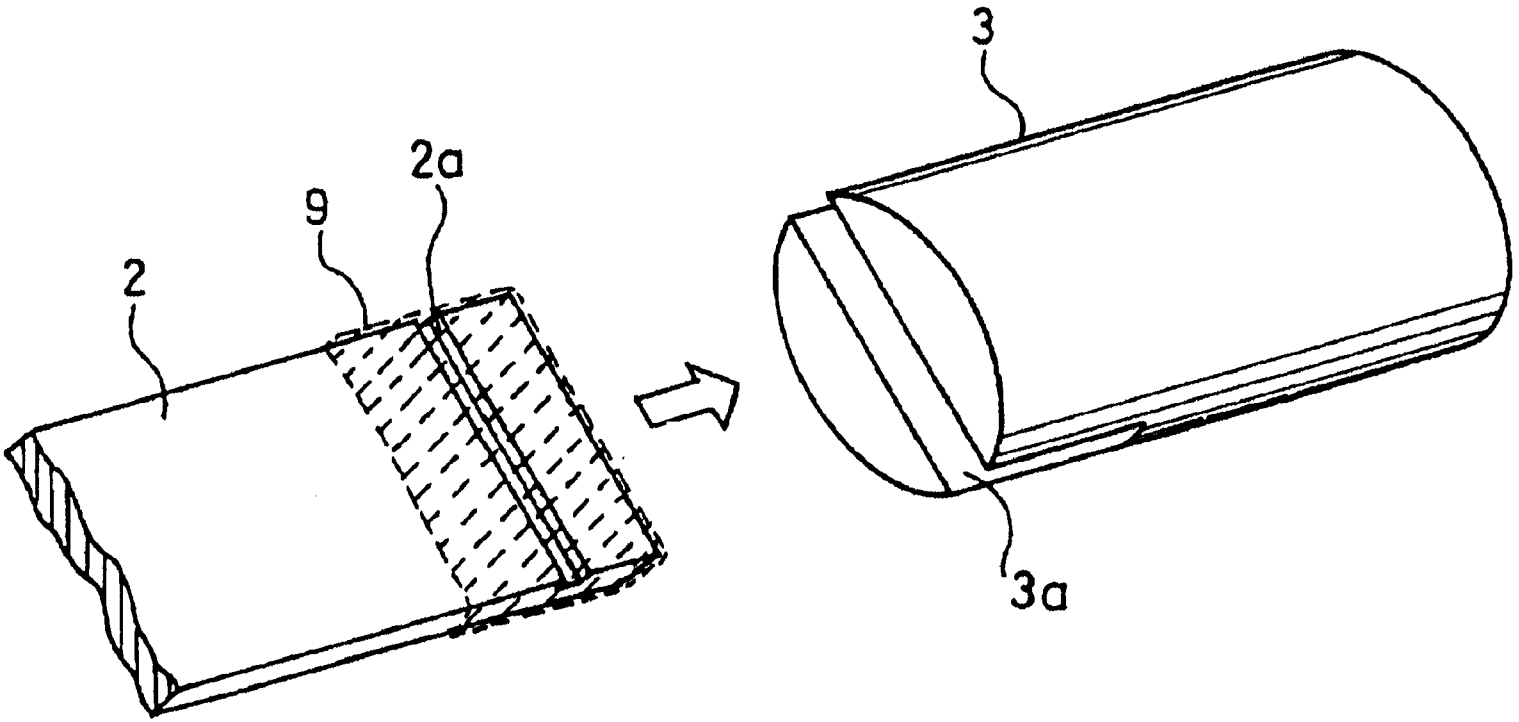
FIG. 2 is a partially magnified view showing the connection portion of the heating element and the heat-emitting block of the infrared ray lamp shown in FIG.

FIG. 2 is a partially magnified perspective view showing the fitting condition of the heating element 2 and the heat-emitting block 3 in accordance with the first embodiment shown in FIG. 1. As shown in FIG. 2, a slit 3*a* is formed at the center of one end portion of the heat-emitting block 3. On the other hand, in the vicinity of the end portion of the heating element 2, a groove 2*a* extending in a direction perpendicular to the insertion direction of the heating element 2 (in the direction indicated by the arrow in FIG. 2) is formed. Furthermore, in the vicinity of the groove 2*a* of the heating element 2, an adhesive 9 is applied. The heating element 2 formed in this way is structured so that it is inserted into the slit 3*a* of the heat-emitting block 3 and secured to each other.

The adhesive 9 applied to the heating element 2 is formed of a carbon-based substance that is converted into a mixture of crystallized carbon such as graphite and amorphous carbon when heated to a high temperature. In the first embodiment, the heat-emitting block 3 is formed of graphite having good conductivity. Furthermore, in the first embodiment, the internal lead wire 4 is formed of a tungsten wire having a thermal expansion coefficient approximately equal to that of carbon. However, other metal wires, such as molybdenum wire and titanium wire, maybe used as the internal leadwire 4, if no problem occurs in heat resistance in working environments. The external lead wire 8 is formed of a molybdenum wire.

In the infrared ray lamp of the first embodiment, the heat-emitting block 3 is close-fitted via the adhesive 9 in the vicinity of the end portion of the plate heating element 2 as described above. In addition, the coil portion 5 of the internal lead wire 4 is wound tightly on the heat-emitting block 3 and secured thereto. In this way, the heating element 2 is electrically connected to the internal lead wire 4 via the adhesive 9 and the heat-emitting block 3. In the internal lead wire 4, the end portion of the spring portion 6, the winding diameter of which is larger than that of the coil portion 5, is electrically connected to the molybdenum foil sheet 7 which is embedded in the sealing portion 1*c* of the glass tube 1. The other end of the molybdenum foil sheet 7 is also connected to the external lead wire 8 inside the sealing portion 1*c*.

In the infrared ray lamp of the first embodiment, the heating element 2, the heat-emitting blocks 3 and the internal lead wires 4 connected in series are inserted into the space inside the heat-resistant glass tube 1, an inert gas, such as argon or nitrogen, is filled inside the glass tube 1, and the end portions (the sealing portions) of the glass tube 1 are melted and fused so as to be sealed. A part of the internal lead wire 4, the molybdenum foil sheet 7 and a part of the external lead wire 8 are sealed in the sealing portion 1*c* of the glass tube 1. The infrared ray lamp of the first embodiment is formed as described above.

In the infrared ray lamp of the first embodiment structured as described above, when the infrared ray lamp is turned on by applying a voltage across the external lead wires 8 disposed at both ends, the heating element 2 formed of the carbon-based substance is heated to a high temperature because of its resistance. Even when the heating element 2 is expanded in its longitudinal direction by this heating, since the spring portion 6 of the internal lead wire 4 is provided between the heating element 2 and the molybdenum foil sheet 7, the effect of the dimensional change due to the expansion of the heating element 2 is cancelled by the contraction of the spring portion 6. As a result, it is possible to prevent any unnecessary bending force from applying to the heating element 2. Since no unnecessary bending force applies to the heating element 2 that becomes brittle at high temperatures, the heating element 2 does not break even at high temperatures.

In the infrared ray lamp of the first embodiment, the heat-emitting block 3 formed of a material having good electric conductivity is connected to the vicinity of the end portion of the heating element 2 by using the carbon-based adhesive having good electric conductivity. For this reason, in the infrared ray lamp of the first embodiment, the contact resistance therebetween can be made small, and the temperature at the connection portion can be lowered.

Next, the fitting condition of the heating element 2 and the heat-emitting block 3 in the infrared ray lamp of the first embodiment will be described in more detail.

As shown in FIG. 2, at manufacturing of an infrared ray lamp, the adhesive 9 mainly consisting of a liquid carbon-based organic substance is sufficiently applied to the end portion of the heat element 2 including the groove 2*a* formed in the vicinity of the end portion of the heating element 2. And then, the heating element 2 applied with the adhesive 9 is inserted into the slit 3*a* of the heat-emitting block 3 to make close contact therewith. After the heating element 2 is made close contact with and fitted into the heat-emitting block 3, drying and heating (firing) are carried out, whereby a sintered substance mainly consisting of the carbon-based substance of the adhesive 9 and having a high conductivity is formed. As a result, the heating element 2 and the heat-emitting block 3 are connected via the sintered substance of the adhesive 9 having high conductivity.

In the first embodiment, by forming the groove 2*a* in the heating element 2, the area of the contact between the heating element 2 and the heat-emitting block 3 increases, and the resistance of the contact can be reduced.

Furthermore, since the adhesive 9 consisting of the carbon-based organic substance is very likely to be stuck to the heat-emitting block 3 formed of graphite, the adhesive 9 enters the groove 2*a*, and the bonding between the heating element 2 and the heat-emitting block 3 is carried out at their projected and recessed faces, whereby the strength of the bonding is enhanced significantly. In the first embodiment, the elucidation has been made on such example of structure that the number of the grooves 2*a* formed in the vicinity of the end portion of the heating element 2 is one, but similar effect can also be obtained even if plural grooves are formed on one face or on both faces; and a higher effect is obtained as the larger the number of the grooves is.

In the first embodiment, even when the clearance between the heating element 2 and the heat-emitting block 3 is of a range of 0 to 100 $\mu$m, no difference occurs in the resistance of the contact and the strength of the bonding.

Next, by using the method of the connection between the heating element and the heat-emitting block of the infrared ray lamp of the above-mentioned first embodiment, the connection between the heating element and the heat-emitting block of the infrared ray lamp having another structure will be described.

Figure 3:
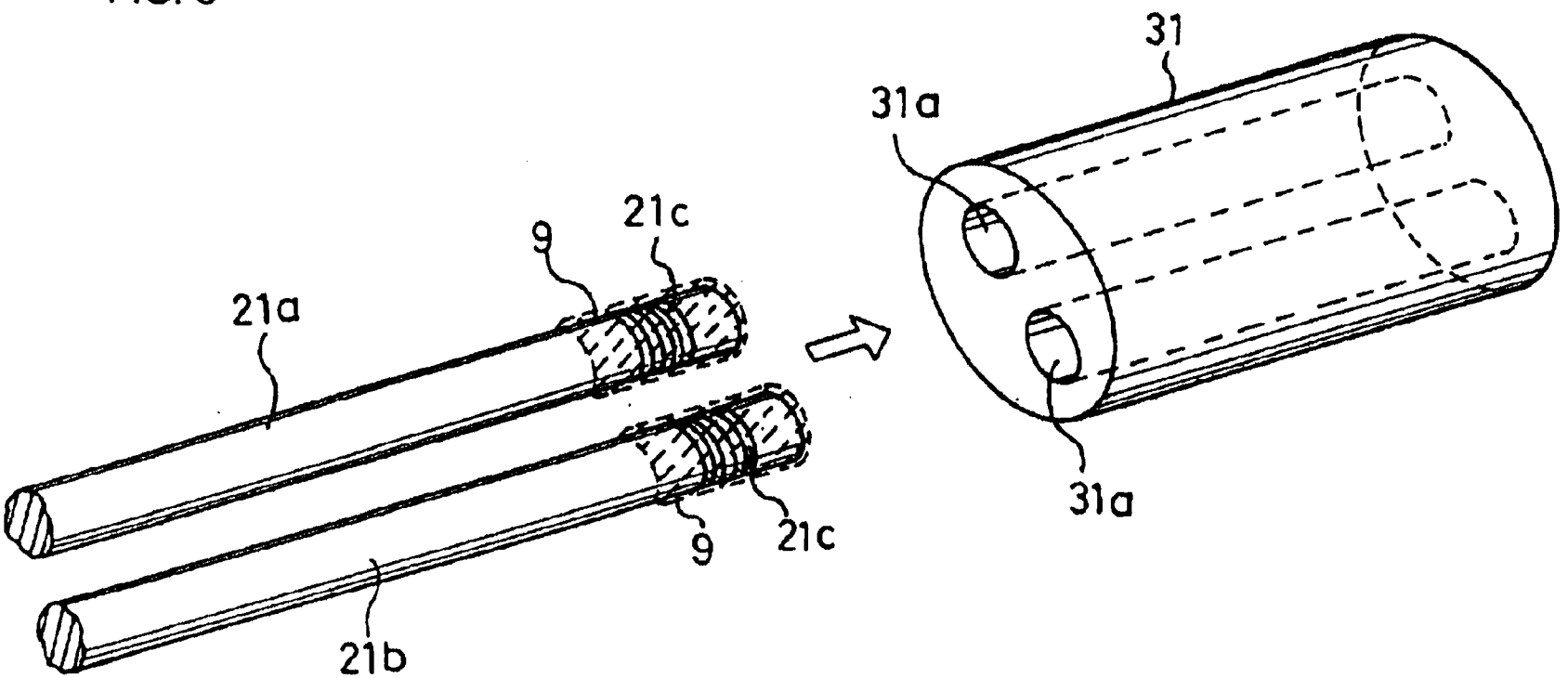
FIG. 3 is a partially magnified view showing the connection portion of the heating element and the heat-emitting block of an infrared ray lamp having another structure in accordance with the first embodiment of the present invention.
Figure 4:
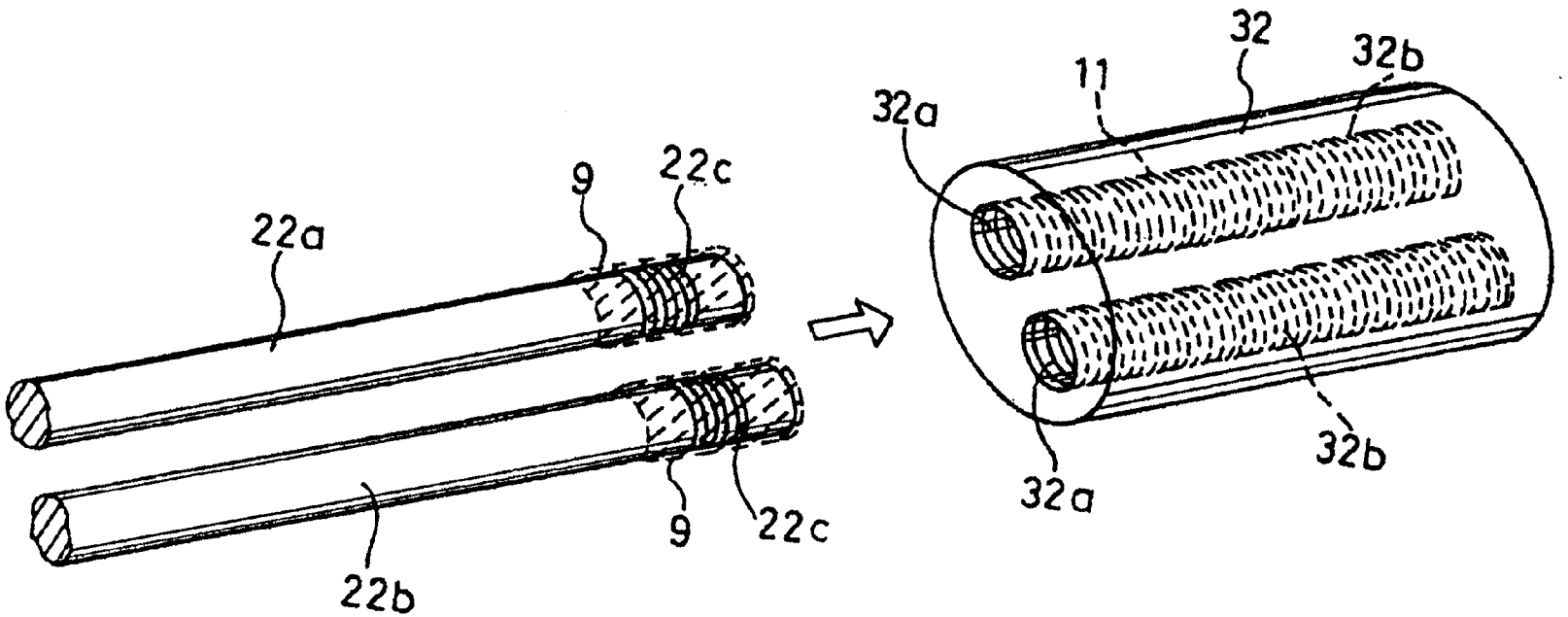
FIG. 4 is a partially magnified view showing the connection portion of the heating element and the heat-emitting block of an infrared ray lamp having still another structure in accordance with the first embodiment of the present invention.

In an infrared ray lamp having two rod-like heating elements 21*a* and 21*b*, FIG. 3 is a partially magnified perspective view showing a method of connecting the heating elements 21*a* and 21*b* to a heat-emitting block 31. FIG. 4 is a partially magnified perspective view showing another method of connecting the heating elements 22*a* and 22*b* to a heat-emitting block 32, in an infrared ray lamp having two of the rod-like heating elements 22*a* and 22*b*.

In the infrared ray lamps shown in FIGS. 3 and 4, structures other than those shown in the figures are similar to those of the first embodiment shown in the above-mentioned FIG. 1.

As shown in FIG. 3, the end portions of the heating elements 21*a* and 21*b* of this infrared ray lamp are inserted into two holes 31*a* and 31*b* formed in the heat-emitting block 31 respectively and connected thereto. The plural grooves 21*c* formed in the heating elements 21*a* and 21*b* extend in a direction perpendicular to the insertion direction (the direction indicated by the arrow in FIG. 3) of the heating elements 21*a* and 21*b*.

The heating elements 21*a* and 21*b* and the heat-emitting block 31 of the infrared ray lamp shown in FIG. 3 are formed of similar materials as those of the above-mentioned first embodiment, and the adhesive 9 of the second embodiment is formed of a carbon-based substance to become a mixture of crystallized carbon such as graphite and amorphous carbon when heated to a high temperature, just as in the case of the first embodiment.

In the vicinities of the end portions of the above-mentioned cylindrical heating elements 21*a* and 21*b*, the plural grooves 21*c* (three grooves in the example shown in FIG. 3) are formed. For this reason, projected and recessed faces are formed in the vicinities of the end portions of the heating elements 21*a* and 21*b*, and the adhesive 9 is sufficiently applied to the end portions including the projected and recessed faces. And, the heating elements 21*a* and 21*b* applied with the adhesive 9 are inserted into the holes 31*a* and 31*a* of the heat-emitting block 31 respectively and made close contact therewith. After the heating elements 21*a* and 21*b* are made close contact with and fitted into the heat-emitting block 31, drying and heating (firing) steps are carried out, whereby a sintered substance consisting of the carbon-based substance of the adhesive 9 is formed. As a result, the heating elements 21*a* and 21*b* are connected to the heat-emitting block 31 via the sintered substance of the adhesive 9 having high conductivity.

In the example shown in FIG. 3, since the projected and recessed faces are formed in the vicinities of the end portions of the cylindrical heating elements 21*a* and 21*b*, the area of the contact between the heating elements 21*a* and 21*b* and the heat-emitting block 31 is increased. Furthermore, the grooves 21*c* are formed in the vicinities of the heating elements 21*a* and 21*b* in a direction perpendicular to the insertion direction, and the sintered substance of the adhesive 9 is formed in the grooves 21*c*. For this reason, the resistance of the contact between the heating elements 21*a* and 21*b* and the heat-emitting block 31 of the infrared ray lamp shown in FIG. 3 can be reduced, and the strength of the bonding can be enhanced significantly.

In the infrared ray lamp shown in FIG. 4, the plural (three in the example shown in FIG. 4) grooves 22*c* are formed on the external faces in the vicinities of the end portions of the two heating elements 22*a* and 22*b*. The plural grooves 22*c* formed in the heating elements 22*a* and 22*b* are provided in a direction perpendicular to the insertion direction (the direction indicated by the arrow in FIG. 4) of each of the heating elements 22*a* and 22*b*, thereby forming projected and recessed faces. In addition, the adhesive 9 is sufficiently applied to the end portions of the heating element 22*a* and 22*b* including the projected and recessed faces in the vicinities thereof.

On the other hand, two holes 32*a* and 32*a* are formed in the heat-emitting block 32, and grooves 32*b* are formed in each of the internal faces of these holes 32*a* and 32*a*. These grooves 32*b* extend in a direction perpendicular to the insertion direction (the direction indicated by the arrow in FIG. 4) of each of the heating elements 22*a* and 22*b*.

The adhesive 9 is applied to the heating elements 22*a* and 22*b* structured as described above, and the heating elements 22*a* and 22*b* are inserted into the holes 32*a* and 32*a* of the heat-emitting block 32 respectively and made close contact therewith. After the heating elements 22*a* and 22*b* are made close contact with and fitted into the heat-emitting block 32, drying and heating (firing) steps are carried out, whereby a sintered substance consisting of the carbon-based substance of the adhesive 9 is formed. As a result, the heating elements 22*a* and 22*b* are connected to the heat-emitting block 32 via the sintered substance of the adhesive 9 of high conductivity.

In the infrared ray lamp shown in FIG. 4, the projected and recessed faces are formed in the vicinities of the end portions of the cylindrical heating elements 22*a* and 22*b*, and the grooves 32*b* are formed in the internal faces of the holes 32*a* and 32*b*. As a result, the area of A the contact between the heating elements 22*a* and 22*b* and the heat-emitting block 32 is increased. Furthermore, the grooves 32*b* are formed in the vicinities of the end portions of the heating elements 22*a* and 22*b* and in the internal faces of the holes 32*a* and 32*a* in a direction perpendicular to the insertion direction. The sintered substance of the adhesive 9 is formed in these grooves 32*b*.

For this reason, in the infrared ray lamp shown in FIG. 4, the resistance of the contact between the heating elements 22*a* and 22*b* and the heat-emitting block 32 can be reduced, and the strength of the bonding therebetween is enhanced significantly.

In the infrared ray lamp shown in FIG. 4, both end portions of the plural heating elements 22*a* and 22*b* are bonded to the holes in the heat-emitting block 32 by using the carbon-based adhesive 9. In the stage when the plural heating elements 22*a* and 22*b* are inserted into the heat-emitting block 32, the carbon-based adhesive 9 is still soft; therefore, even when balance of the tension or compression force between the heating elements is distorted, the distortion is relieved until a heat treatment for curing the adhesive 9 is conducted. Then, after balance of the tension or compression force between the plural heating elements is made nearly uniform, the adhesive 9 is cured and carbonized. As a result, even when the heating elements 22*a* and 22*b* are heated to a high temperature, the distortion of the tension or compression force balance between the heating elements does not increase to such extent that the heating elements 22*a* and 22*b* are broken. By producing the infrared ray lamp as described above, it is possible to easily create a long-life infrared ray lamp having plural heating elements 22*a* and 22*b* sealed in one glass tube.

In the infrared ray lamps shown in FIGS. 3 and 4, similar effects can be obtained regardless of whether the holes 31*a* and 32*a* formed in the heat-emitting blocks 31 and 32 are through holes or stop holes (holes with bottom).

Second Embodiment

Figure 5:
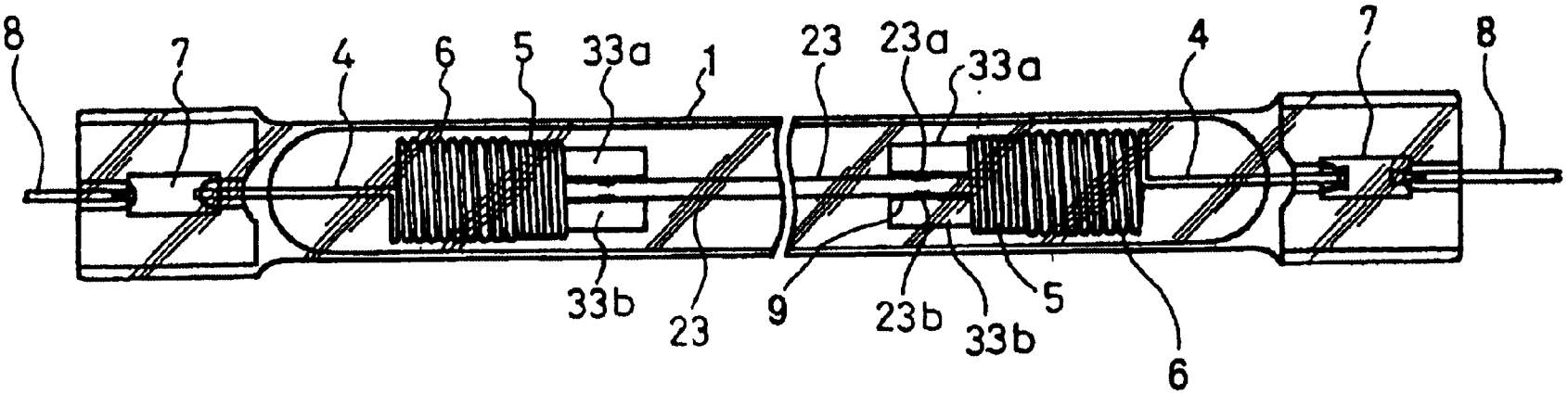
FIG. 5 is a front view showing the structure of the lead wire taking-out portion of an infrared ray lamp in accordance with a second embodiment of the present invention.
Figure 6:
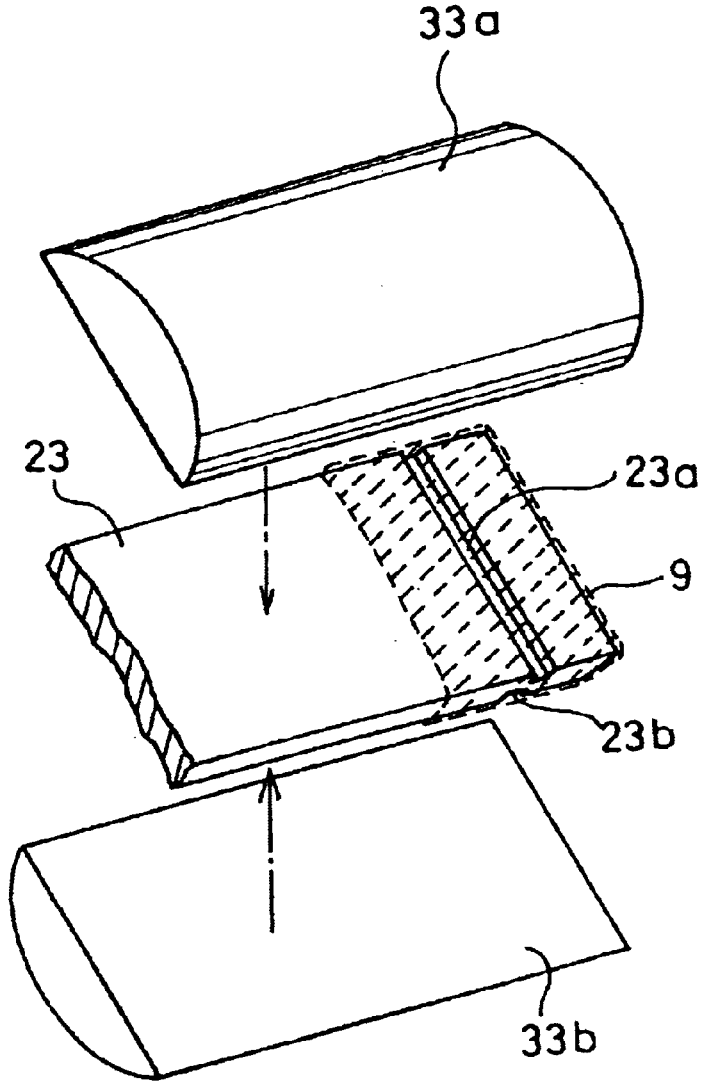
FIG. 6 is a partially magnified view showing the connection portion of the heating element and the heat-emitting block of the infrared ray lamp shown in FIG. 5.
Figure 7:
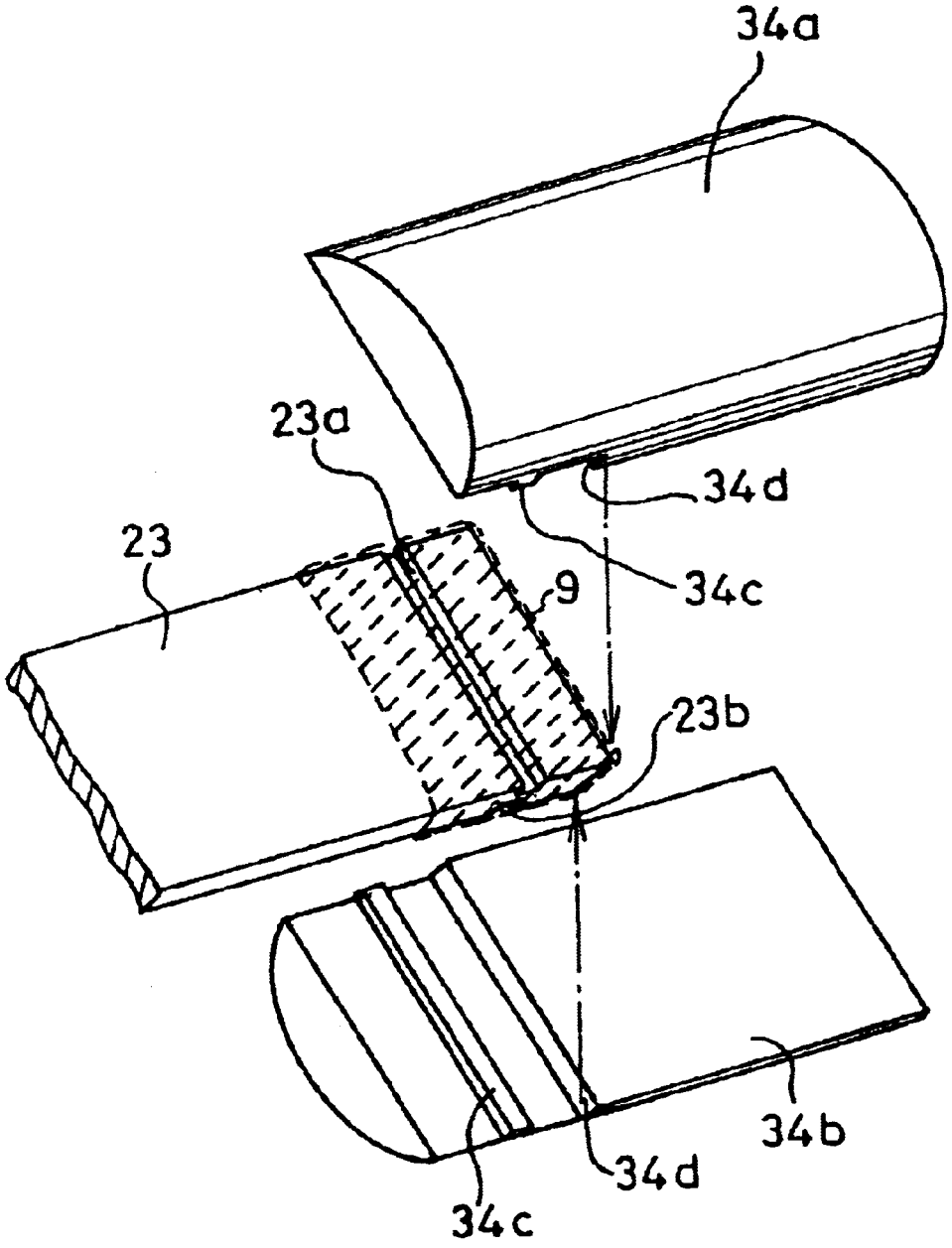
FIG. 7 is a partially magnified view showing the connection portion of the heating element and the heat-emitting block of an infrared ray lamp having another structure in accordance with the second embodiment.
Figure 8:
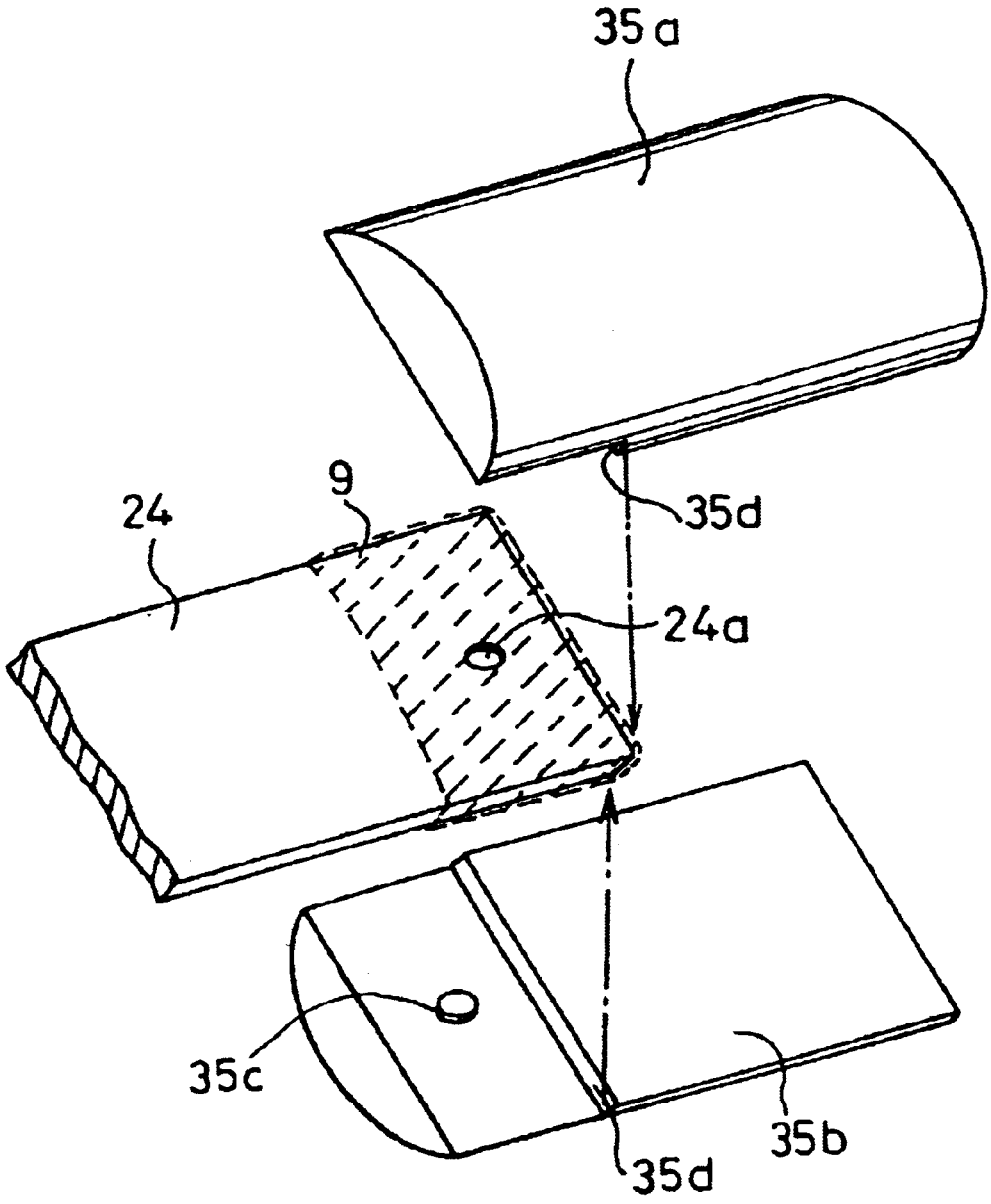
FIG. 8 is a partially magnified view showing the connection portion of the heating element and the heat-emitting block of an infrared ray lamp having still another structure in accordance with the second embodiment.

Next, an infrared ray lamp in accordance with a second embodiment of the present invention will be described referring to the accompanying drawings. FIG. 5 is a plan view showing the infrared ray lamp of the second embodiment in accordance with the present invention. FIG. 5 shows both end portions of the infrared ray lamp of the second embodiment. Since its central portion has a continuous structure connecting both end portions, the central portion is not shown in FIG. 5. FIG. 6 is a partially magnified perspective view showing the connection condition between a heating element and heat-emitting blocks in accordance with the second embodiment shown in FIG. 5. FIGS. 7 and 8 show other structures of the infrared ray lamp of the second embodiment, and are partially magnified perspective views showing the methods of the connection between the heating element and the heat-emitting blocks.

The infrared ray lamp of the second embodiment in accordance with the present invention has a plate heating element 23 and two-split heat-emitting blocks 33*a* and 33*b*. Since the other structures of the second embodiment are similar to those of the above-mentioned first embodiment, their explanations are omitted.

In the infrared ray lamp of the second embodiment, the heating element 23, the heat-emitting blocks 33*a* and 33*b* and the internal lead wires 4 are sealed in the glass tube 1 as shown in FIGS. 5 and 6, just as in the case of the above-mentioned first embodiment. The internal lead wire 4 is connected to the external lead wire 8 via the molybdenum foil sheet 7. The plate heating element 23 sealed in the glass tube 1 is formed of a carbon-based substance consisting of a mixture of crystallized carbon such as graphite, a resistance value adjustment substance and amorphous carbon. This heating element 23 has a plate shape measuring 6 mm in width, 0.5 mm in thickness and 300 mm in length for example. The heat-emitting blocks 33*a* and 33*b* are formed of a conductive material and electrically connected to one end of the heating element 23 by a method described later. A coil portion 5 is formed at one end of the internal lead wire 4, and a spring portion 6 having elasticity is formed following the coil portion 5.

As shown in FIG. 6, in the infrared ray lamp of the fourth embodiment, grooves 23*a* and 23*b* are formed in the top and bottom faces of the end portion of the plate heating element 23 respectively. The grooves 23*a* and 23*b* extend in a direction perpendicular to the longitudinal direction of the heating element 23. The adhesive 9 is sufficiently applied to the vicinity of the end portion of the heating element 23 including these grooves 23*a* and 23*b*. In the end portion of this heating element 23, a pair of heat-emitting blocks 33*a* and 33*b* are bonded via the adhesive 9 having high conductivity so as to attain electrical connection. The adhesive 9 is formed of a carbon-based substance that is converted into a mixture of crystallized carbon such as graphite and amorphous carbon when heated to a high temperature. The heat-emitting blocks 33*a* and 33*b* are two blocks having similar shape, i.e., a nearly semicircular shape in cross section, and formed of graphite having good conductivity.

In the second embodiment, the internal lead wire 4 is formed of a tungsten wire having a thermal expansion coefficient close to that of carbon. However, other metal wires, such as molybdenum and titanium wires, may be used as the internal lead wire 4, if no problem occurs in heat resistance in working environments. The external lead wire 8 is formed of a molybdenum wire.

As described above, in the infrared ray lamp of the second embodiment, the heat-emitting blocks 33*a* and 33*b* sandwich the vicinity of the end portion of the plate heating element 23 via the adhesive 9 so as to attain bonding. Furthermore, the coil portion 5 of the internal lead wire 4 is wound tightly around the heat-emitting blocks 33*a* and 33*b* and secured thereto. In this way, the heating element 23 is electrically connected to the internal lead wires 4 via the adhesive 9 and the heat-emitting blocks 33*a* and 33*b*. In the internal lead wire 4, the end portion of the spring portion 6, the winding diameter of which is larger than that of the coil portion 5, is electrically connected to the molybdenum foil sheet 7 embedded in the sealing portion of the glass tube 1. The other end of this molybdenum foil sheet 7 is also connected to the external lead wire 8 inside the sealing portion.

In the infrared ray lamp of the second embodiment, the heating element 23, the heat-emitting blocks 33*a* and 33*b* and the internal lead wire 4 connected in series are inserted into the space inside the heat-resistant glass tube. After filling an inert gas, such as argon or nitrogen in the space inside the glass tube 1, the end portions (the sealing portions) of the glass tube 1 are melted and fused so as to be sealed. A part of the internal lead wire 4, the molybdenum foil sheet 7 and a part of the external lead wire 8 are sealed in the sealing portion of the glass tube 1. The infrared ray lamp of the second embodiment is formed as described above.

In the infrared ray lamp of the second embodiment structured as described above, when the infrared ray lamp is turned on by applying a voltage across the external lead wires 8 (FIG. 5) disposed at both ends, the heating element 23 formed of the carbon-based substance is heated to a high temperature because of its resistance. Even when the heating element 23 is expanded in its longitudinal direction by this heating, since the spring portion 6 of the internal lead wire 4 is provided between the heating element 23 and the molybdenum foil sheet 7, the dimensional change due to the expansion of the heating element 23 is absorbed by the contraction of the spring portion 6. As a result, it is possible to prevent any unnecessary bending force from applying to the heating element 23. For this reason, no unnecessary bending force is applied to the heating element 23 that is brittle at high temperatures, and the heating element 23 does not break even at high temperatures.

In the infrared ray lamp of the second embodiment, the heat-emitting blocks 33*a* and 33*b* formed of a material having good electric conductivity are connected to the vicinity of the end portion of the heating element 23 via the carbon-based adhesive having good electric conductivity. For this reason, in the infrared ray lamp of the second embodiment, the contact resistance can be decreased, and the temperature at the connection portion can be lowered.

Next, the bonding condition of the heating element 23 and the heat-emitting blocks 33*a* and 33*b* in the infrared ray lamp of the second embodiment will be described in more detail.

As shown in FIG. 6, in the infrared ray lamp of the second embodiment, the grooves 23*a* and 23*b* are formed in the top and bottom faces of the vicinity of the end portion of the heating element 23. The adhesive 9 formed of a liquid carbon-based organic substance is sufficiently applied to the end portion including the grooves 23*a* and 23*b*, and the heating element 23 is sandwiched between a pair of the heat-emitting blocks 33*a* and 33*b* and bonded thereto. After this bonding, the heating element 23 and the heat-emitting blocks 33*a* and 33*b* are dried and heated (fired), thereby securely connected by the sintered substance formed of the carbon-based substance of the adhesive 9 and having high conductivity.

In the second embodiment, by forming the grooves 23*a* and 23*b* in the heating element 23, the area of the contact between the heating element 23 and the heat-emitting blocks 33*a* and 33*b* increases, whereby the resistance of the contact can be reduced.

Furthermore, since the adhesive 9 formed of the carbon-based organic substance is very likely to be stuck to the heat-emitting blocks 33*a* and 33*b* formed of graphite, the adhesive 9 enters the grooves 23*a* and 23*b*, and the bonding between the heating element 23 and the heat-emitting blocks 33*a* and 33*b* is carried out at their projected and recessed faces, whereby the strength of the bonding is enhanced significantly. In the second embodiment, the structure wherein the number of the grooves formed in the vicinity of the end portion of the heating element 23 is one is explained as an example; however, an effect can also be obtained even if plural grooves are formed on one face or on both faces, and a higher effect is obtained as the number of the grooves increases.

In the second embodiment, the heating element 23 is bonded to the heat-emitting blocks 33*a* and 33*b* by pressure contact. As a result, unlike the case of an assembly process such as a fitting process, it is not necessary to accurately place the heating element and the heat-emitting blocks at predetermined positions; the assembly work can thus be carried out easily, and the cost of production can be reduced significantly.

FIG. 7 is a partially magnified perspective views showing another structure of the infrared ray lamp of the second embodiment, and shows an example of the method of the connection between the plate heating element 23 and two-split heat-emitting blocks 34*a* and 34*b*.

As shown in FIG. 7, grooves 23*a* and 23*b* are formed in the top and bottom faces in the vicinity of the end portion of the heating element 23. The grooves 23*a* and 23*b* extend in a direction perpendicular to the longitudinal direction of the heating element 23. The adhesive 9 formed of a liquid carbon-based organic substance is sufficiently applied to the end portion including these grooves 23*a* and 23*b*.

On the other hand, a hollowed step portion 34*d* is formed on each of the heat-emitting blocks 34*a* and 34*b* at a position for sandwiching the heating element 23. In addition, a projected portion 34*c* is formed on this step portion 34*d*. This projected portion 34*c* is formed at a position wherein it fits in each of the grooves 23*a* and 23*b* formed in the above-mentioned heating element 23.

The heating element 23 structured as described above is placed between the two heat-emitting blocks 34*a* and 34*b* and bonded thereto. At this time, the projected portions 34*c* of the heat-emitting blocks 34*a* and 34*b* fit in the grooves 23*a* and 23*b* in the heating element 23. After this fitting, the heating element 23 and the heat-emitting block 34*a* and 34*b* are dried and heated (fired), thereby securely connected by the sintered substance formed of the carbon-based substance of the adhesive 9 and having high conductivity.

Since the second embodiment shown in FIG. 7 is structured so that the projected portions 34*c* of the heat-emitting blocks 34*a* and 34*b* fit in the grooves 23*a* and 23*b* in the heating element 23, the area of the contact between the heating element 23 and the heat-emitting blocks 34*a* and 34*b* increases, whereby the resistance of the contact can be reduced.

In addition, since the projected portions 34*c* fit in the grooves 23*a* and 23*b*, the bonding condition between the heating element 23 and the heat-emitting blocks 34*a* and 34*b* via the adhesive 9 becomes strong, whereby the strength of the bonding is enhanced.

The structure wherein the grooves are formed in the heating element 23 and the projected portions are formed on the heat-emitting blocks 34*a* and 34*b* is explained as an example in the second embodiment; however, the present invention is not limited to this kind of structure; the grooves and the projected portions may be formed opposite to each other, and the number of each is not limited to one.

FIG. 8 is a partially magnified perspective views showing still another structure of the infrared ray lamp of the second embodiment, and shows the method of the connection between a plate heating element 24 and two-split heat-emitting blocks 35*a* and 35*b*.

As shown in FIG. 8, a through hole 24*a* is formed in the vicinity of the end portion of the heating element 24. The adhesive 9 formed of a liquid carbon-based organic substance is sufficiently applied to the end portion including this through hole 24*a*.

On the other hand, a hollowed step portion 35*d* is formed on each of the heat-emitting blocks 35*a* and 35*b* at a position for sandwiching the heating element 24. In addition, a projected portion 35*c* is formed on this step portion 35*d*. This projected portion 35*c* is formed at a position wherein it fits in the through hole 24*a* formed in the above-mentioned heating element 24.

The heating element 24 structured as described above is sandwiched between the two heat-emitting blocks 35*a* and 35*b* and bonded thereto. At this time, the projected portions 35*c* of the heat-emitting blocks 35*a* and 35*b* fit in the through hole 24*a* in the heating element 24. After this bonding, the heating element 24 and the heat-emitting block 35*a* and 35*b* are dried and heated (fired), thereby securely connected by the sintered substance formed of the carbon-based substance of the adhesive 9 and having high conductivity.

Since the embodiment shown in FIG. 8 is structured so that the projected portions 34*c* of the heat-emitting blocks 35*a* and 35*b* fit in the through hole 24*a* in the heating element 24, the area of the contact between the heating element 24 and the heat-emitting blocks 35*a* and 35*b* increases, whereby the resistance of the contact can be reduced.

In addition, since the projected portions 35*c* fit in the through hole 24*a*, the condition of the bonding between the heating element 24 and the heat-emitting blocks 35*a* and 35*b* via the adhesive 9 becomes strong, whereby the strength of the bonding is enhanced.

The structure wherein the through hole and the projected portion are circular and the number of each is one is explained as an example in the embodiment shown in FIG. 8; however, the present invention is not limited to this kind of structure; if an oval hole and an oval projected portion are used or if plural holes and plural projections are used and if they can be fitted into each other for example, similar effect as that of the above-mentioned embodiment can be obtained.

Furthermore, it may be possible to use the structure wherein only the projected portion 35*c* shown in FIG. 8 is formed into a rod shape as a separate piece, and a through hole is formed in the step portion 35*d* of each of the heat-emitting blocks 35*a* and 35*b* so that the rod-like projected portion is inserted into the through holes in the heat-emitting blocks 35*a* and 35*b* and the thorough hole 24*a* in the heating element 24. With this structure, the heat-emitting blocks 35*a* and 35*b* can be processed easily, and the cost of production can be reduced.

The heat-emitting block formed of graphite having conductivity and an electrode terminal function is explained as an example in the first and second embodiments; however, the material of the heat-emitting block is not limited to graphite; various materials having heat resistance up to 1200° C., good electrical conductivity and good thermal conductivity are applicable. Since graphite itself is low in hardness and strength for example, various materials enhanced in hardness and strength, such as a material obtained by mixing a carbide, a nitride, a boride, etc. with graphite and by firing the mixture, a material obtained by adding glass-like carbon to graphite and by firing the mixture, and the like, are applicable.

The present invention has the following effect as made clear by the above-mentioned detailed explanations of the first and second embodiments.

In accordance with the present invention, the heating portions can be prevented from fusing and breaking during use for a long time, whereby it is possible to obtain an infrared ray lamp having high reliability and long life.

The infrared ray lamp of the present invention uses a heating element formed of a carbon-based substance and formed into a rod-like shape instead of the conventional tungsten spiral filament, and the infrared ray emission rate of the rod-like carbon-based substance is high, 78 to 84%; for this reason, the infrared ray emission rate of the infrared ray lamp is high.

Furthermore, since the rod-like carbon-based substance has a negative temperature characteristic wherein the resistance lowers as the temperature rises, it is possible to reduce the rush current at the time when the infrared ray lamp of the present invention is turned on.

Furthermore, since the infrared ray lamp of the present invention is structured such that the heat-emitting blocks having good conductivity are bonded to the end portions of the rod-like carbon-based heating element, the resistance of the contact between the heating element and the heat-emitting blocks at the time of heating can be reduced, and temperature increase can be lowered, whereby it is possible to significantly enhance the reliability of the lead wire installation portions.

Furthermore, the infrared ray lamp of the present invention has the structure wherein the projected and recessed portions are formed between the rod-like carbon-based heating element and the heat-emitting blocks and then bonded and fired via the carbon-based adhesive. Because of this structure, the strength of the bonding portions of the infrared ray lamp of the present invention becomes high.

Furthermore, since the rod-like carbon-based heating element and the adhesive for joining the heat-emitting blocks are formed of similar material, their thermal expansion coefficients are almost similar, whereby it is possible to provide a highly reliable infrared ray lamp not causing any accidents, such as breakage, during on-off switching operation for a long time. Furthermore, since the structure wherein the rod-like carbon-based heating element and the heat-emitting blocks are bonded by the fitting due to the engagement of the projected and recessed portions and by using the carbon-based adhesive is used in the present invention, it is possible to enhance workability and to raise quality at the time of the bonding.

In accordance with the method of producing the infrared ray lamp of the present invention, it is possible to obtain a highly reliable infrared ray lamp characterized in that its power consumption does not change abnormally even after use for a long time, and that the heating portions are prevented from fusing and breaking during use for a long time; furthermore, it is possible to enhance workability and to raise quality at the time of the assembly and bonding.

Third Embodiment

Next, a third embodiment of the present invention will be described referring to the accompanying drawings. However, the materials, sizes, production methods and the like of the embodiment described below are only examples preferable for an embodiment of the present invention. The applicable range of the present invention is therefore not limited by these examples.

Part (a) of FIG. 9 is a plan view showing an infrared ray lamp in accordance with the third embodiment of the present invention, and part (b) is a front view thereof. In addition, FIG. 10 is a perspective view showing the infrared ray lamp of FIG. 9. However, since the central portion of the infrared ray lamp can be understood from both side portions shown in the figures, the central portion of the infrared ray lamp is not shown in either of the figures.

The infrared ray lamp of the third embodiment comprises a substantially cylindrical glass tube 301, metal foil sheets 305 embedded in both end portions 301*c* of this glass tube 301, a heating element 302 hermetically sealed inside the glass tube 301, heat-emitting blocks 303 secured to both end portions of the heating element 302, internal lead wires 304 for connecting the heat-emitting blocks 303 to the metal foil sheets 305, and external lead wires 306 for connecting the metal foil sheets 305 to an external electric circuit.

The glass tube 301 is formed of quartz glass. The cylindrical portion of the glass tube 301 is about 10 mm in outside diameter, about 1 mm in thickness and about 360 mm in length. The sealing portions 301*c* at both ends of the cylindrical portion are each formed into a plate shape, and an argon gas having atmospheric pressure is filled inside the cylindrical portion.

The heating element 302 is formed of a carbon-based substance consisting of a mixture of crystallized carbon such as graphite, a resistance value adjustment substance such as a nitrogen compound and amorphous carbon. The resistance value adjustment substance is mixed to adjust the resistance of the heating element 302. This resistance value adjustment substance is used to make the resistance value of the heating element higher than that of a heating element formed of only carbon.

The heating element 302 in accordance with the third embodiment has a plate shape having a thickness t of 0.5 mm, a width T of 1.0 mm (=2t), 2.5 mm (=5t) or 6.0 mm (=12t) and a length of about 300 mm. However, the plate heating element 302 having a width T of 6.0 mm (=12t) is shown in FIGS. 9 and 10.

The heat-emitting blocks 303 secured to both end portions of the heating element 302 are formed of a carbon-based substance similar to that of the heating element 302. The shape of the heat-emitting block 303 has a substantially cylindrical shape having about 6 mm in diameter and about 20 mm in length. A slit 303*a*, in which the longitudinal end portion of the heating element 2 is inserted, is formed in the end face 303*b* of the heat-emitting block 303 opposed to the heating element 302 so as to pass through its center. The heating element 2 is fitted into this slit 303*a* and secured to the heat-emitting block 303. The internal lead wire 304 is wound tightly around the central portion of the heat-emitting block 303, thereby forming a close-contact portion 304*a*.

The cross-sectional area of the heat-emitting block 303 is sufficiently larger than the cross-sectional area of the heating element 302 (about nine times or more in the third embodiment). The resistance value of the heat-emitting block 303 is therefore sufficiently smaller than the resistance value of the heating element 302. As a result, when a current flows through the heating element 302 and the heating element 302 generates heat, the heat generation at the heat-emitting block 303 itself is sufficiently smaller than that at the heating element 302 and negligible as described later. In addition, although heat is transmitted from the heating element 302 to the heat-emitting block 303, part of the heat is emitted from the surface of the heat-emitting block 303. As a result, the amount of the heat transmitted from the heat-emitting block 303 to the internal lead wire 304 is very scarce, and the internal lead wire 304 is therefore not overheated.

The internal lead wire 304 is formed of molybdenum or tungsten, and is a conductive wire of about 0.7 mm in diameter. The internal lead wire 304 has a spiral coil portion 304*b* following the close-contact portion 304*a* wound around the heat-emitting block 303. The spiral coil portion 304*b* is larger than the close-contact portion 304*a* by about 0.5 to 1.0 mm in diameter, and is provided so as to be coaxial with the center axis of the heat-emitting block 303. The spiral coil portion 304*b* is disposed away from the side face of the heat-emitting block 303 by a predetermined distance so that it can expand and contract like a coil spring in the axial direction of the heat-emitting block 303. In addition, one end of the internal lead wire 304 is secured to the metal foil sheet 305 by crimping. At the time of assembly, the internal lead wires 304 on both sides are pulled so that each of them becomes longer about 3 mm outwardly in the longitudinal direction than its normal length, whereby the heating element 302 is secured.

As described above, in the third embodiment, the heating element 302 is electrically connected to the metal foil sheets 305, and pulled appropriately to both sides thereof by the internal lead wires 304, thereby secured stably. At this time, the heating element 302 is secured so that the center line of the heating element 302 in the longitudinal direction thereof is aligned with the center axis of the glass tube 301.

In addition, the spiral coil portion 304*b* of the internal lead wire 304 has a function described below. As described later, when a current flows through the heating element 302 and the heating element 302 generates heat, the temperatures of the heating element 302 and the glass tube 301 are raised by the heat, and they undergo thermal expansion. At this time, a thermal stress occurs between the heating element 302 and the glass tube 301 because of the difference between their thermal expansion coefficients. This thermal stress is absorbed by the elasticity of the spiral coil portion 304*b*. Because of this structure, in the third embodiment, the connection between the heat-emitting block 303 and the metal foil sheet 305 via the internal lead wire 304 is not impaired by the thermal stress.

The metal foil sheet 305 is a molybdenum foil sheet measuring about 3 mm by 7 mm by 0.02 mm (thickness). The inner lead wire 304 is secured to one end of the metal foil sheet 305, and the external lead wire 306 is secured to the other end thereof. The external lead wire 306 is formed of molybdenum and welded to the metal foil sheet 305.

When a voltage is applied to the heating element 302 via the external lead wires 306, a current flows through the heating element 302. Since the heating element 302 has a resistance, heat generates from the heating element 302. At this time, the heating element 302 emits infrared rays.

Part (a) of FIG. 11 is a graph showing the distribution curve of the intensity of the infrared rays emitted from the heating element 302 of the third embodiment. Part (b) of FIG. 11 shows the cross section of the central portion of the infrared ray lamp of the third embodiment having the heating element 302. The x and y axes shown in the parts (a) and (b) of FIG. 11 are orthogonal coordinate axes on a plane perpendicular to the axial direction of the heating element 302 shown in FIG. 10. In the parts (a) and (b) of FIG. 11, the origin 0 corresponds to the center axis of the heating element 302. In the graph of the part (a) of FIG. 11, the values in the radial directions designate the emission intensity of the infrared rays, and the values in the circumferential directions designate angles with respect to the center axis on the plane perpendicular to the axial direction of the heating element 302. These angles are designated by angles from the positive direction of the x axis.

The thick solid line 307*a*, the thin solid line 307*b* and the broken line 307*c* in the part (a) of FIG. 11 designate the intensity distribution curves in the case when the width T of the heating element 302 is 6.0 mm, 2.5 mm and 1.0 mm, respectively. Since the thickness (t) of the heating element 302 is 0.5 mm, the intensity distribution curve 307*a* is obtained in the case when the width T (6.0 mm) of the heating element 302 is 12t, the intensity distribution curve 307*b* is obtained in the case when the width T (2.5 mm) of the heating element 302 is 5t, and the intensity distribution curve 307*c* is obtained in the case when the width T (1.0 mm) of the heating element 302 is 2t.

In the third embodiment, the intensity distribution curves 307*a*, 307*b* and 307*c* were measured as described below.

First, a constant voltage is applied to a 600W infrared ray lamp, and infrared rays are emitted from the infrared ray lamp. In a condition wherein infrared rays are emitted from the infrared ray lamp stably, the amount of the infrared rays is measured at a position located a constant distance (about 300 mm) away from the center line (the origin 0 of FIG. 11) of the heating element 302 in a direction perpendicular thereto. At this time, the amount of infrared rays reaching a predetermined minute area at a predetermined position is measured. This measurement is repeated while the angle with respect to the heating element 302 is changed, with the distance from the origin 0 being maintained constant. As the result of this measurement, the intensity distribution curves 307*a*, 307*b* and 307*c* shown in the part (a) of FIG. 11 were obtained.

As indicated by the intensity distribution curves 307*a*, 307*b* and 307*c* shown in the part (a) of FIG. 11, the directivity of the intensity of the infrared rays emitted from the heating element 302 becomes higher as the ratio of the width T to the thickness t of the heating element 2 becomes higher. When T≧5t in particular, that is, when the ratio of the width T to the thickness t is five or more, the emission intensity in the y axis direction is significantly lower than that in the x axis direction.

When the infrared rays are emitted unequally as described above, for example, when only a predetermined region is desired to be heated, the region should be placed on the x axis. On the contrary, when only the predetermined region is not desired to be heated, the region should be placed on the y axis. As a result, in the third embodiment, the emission intensity can have directivity, even if such a reflection plate as that used for the conventional infrared ray lamp shown in the above-mentioned FIGS. 25 and 26 is not provided.

The heating element 302 of the third embodiment is formed of a carbon-based substance consisting of a mixture of crystallized carbon such as graphite, a resistance value adjustment substance such as a nitrogen compound and amorphous carbon. As described above, the carbon-based substance used as the material of the heating element 302 has an infrared ray emission rate higher than those of the conventional nichrome and tungsten. For this reason, when the carbon-based substance is used as the heating element 302 of the infrared ray lamp, the efficiency of the emission from the heating element 302 is higher than those from the conventional heating elements.

Furthermore, since the resistance value of the heating element 302 of the third embodiment is higher than those of the conventional heating elements, even if the surface area of the heating element having the shape of a rod, a plate or the like is smaller than those of the conventional heating elements, the heating element can emit infrared rays having sufficient intensity. As a result, since the surface area of the heating element 302 is smaller than those of the conventional heating elements, heat emission from the heating element 302 to the gas around the element is scarce, whereby efficiency reduction due to heat emission from the heating element 302 is restricted.

Because of the above-mentioned reasons, when a constant voltage is applied to the infrared ray lamp, the emission intensity of the third embodiment shown in the part (a) of FIG. 11 is about 20 to 30% higher than the emission intensity, shown in the part (a) of the above-mentioned FIG. 24, of the conventional infrared ray lamp having the heating element 240 formed of nichrome or tungsten.

In the part (a) of FIG. 11 and the part (a) of FIG. 24, the concentric gradations for the emission intensity indicate similar intensity values respectively.

However, the fact that the heating element 302 is formed of the carbon-based substance is not essential in the present invention. Even if the heating element 302 is formed of the conventional nichrome or tungsten, when the width T of the heating element 302 is larger than its thickness t by five times or more, it is possible to obtain emission intensity having such relatively high directivity as those indicated by the intensity direction curves 307*a* and 307*b* shown in the part (a) of FIG. 11.

Although the heating element 302 of the third embodiment formed integrally into the shape of a rod or plate is explained as an example, the heating element of the present invention is not limited to this kind of shape; a bundle obtained by binding plural rod-like members for example may be used as a whole to form a heating member.

Furthermore, although the infrared ray lamp of the third embodiment having the emission blocks 303 is explained as an example, the present invention is not limited to this kind of structure. In the case when the amount of the heat transmitted from the heating element to the internal lead wires is scarce to the extent that the internal lead wires are not overheated for example in accordance with the specifications of an infrared ray lamp, the structure wherein the emission blocks are omitted is also applicable.

Fourth Embodiment

Next, a fourth embodiment of the present invention will be described referring to the accompanying drawings. However, the materials, sizes, production methods and the like of the embodiment described below are only examples preferable for an embodiment of the present invention. The applicable range of the present invention is therefore not limited by these examples.

Part (a) of FIG. 12 is a plan view showing an infrared ray lamp in accordance with the fourth embodiment of the present invention, and part (b) is a front view thereof. In addition, FIG. 13 is a perspective view showing the infrared ray lamp of FIG. 12. However, since the central portion of the infrared ray lamp can be understood from both side portions shown in the figures, the central portion of the infrared ray lamp is not shown in either of the figures.

Furthermore, in the fourth embodiment, similar components as those of the third embodiment shown in FIGS. 9 and 10 are designated by the same numerals, and their explanations are omitted.

The infrared ray lamp of the fourth embodiment has a reflection film 301*a* for infrared rays in a constant range on the external face of the glass tube 301 as shown in FIGS. 12 and 13, in addition to the structure of the third embodiment. The reflection film 301*a* is a gold thin film evaporated on the external face of the glass tube 301 so as to have a thickness of about 5 $\mu$m. This reflection film 301*a* reflects about 70% of the infrared rays emitted from the heating element 302. As shown in FIGS. 12 and 13, the reflection film 301*a* is disposed between the heat-emitting blocks 303 provided on both sides, in other words, disposed at a position opposed to the light-emitting portion of the heating element 302 in the longitudinal direction thereof. This reflection film 301*a* has a semi-cylindrical shape, and the internal face of the reflection film 301*a* is disposed so as to be opposed to the wider side face 302*a* of the heating element 302.

Part (a) of FIG. 14 is a graph showing the distribution curve 307*d* of the intensity of the infrared rays emitted from the heating element 302 of the fourth embodiment. Part (b) of FIG. 14 shows the cross section of the central portion of the infrared ray lamp of the fourth embodiment having the heating element 302. The x and y axes shown in the parts (a) and (b) of FIG. 14 are orthogonal coordinate axes on a plane perpendicular to the axial direction of the heating element 302 shown in FIG. 13. In the parts (a) and (b) of FIG. 14, the origin 0 corresponds to the center axis of the heating element 302. In the parts (a) of FIG. 14, the values in the radial directions designate the emission intensity of the infrared rays, and the values in the circumferential directions designate angles with respect to the center axis on the plane perpendicular to the axial direction of the heating element 302. These angles are designated by angles from the positive direction of the x axis. The concentric gradations for the emission intensity in the part (a) of FIG. 14 indicate the same values of the gradations in the part (a) of FIG. 11.

In addition, a constant power of 600 W is applied to the infrared ray lamp. Since the measurement method is the same as that of the third embodiment, its explanation is omitted.

As indicated by the intensity distribution curve 307*d* in the part (a) of FIG. 14, the infrared rays from the heating element 302 are emitted most intensely in the positive direction of the x axis, that is, in a direction opposite to the reflection plate 301*a* with respect to the heating element 302 (the right direction in the part (b) of FIG. 14). The maximum emission intensity is about 1.5 times as high as that of the infrared ray lamp of the third embodiment.

On the other hand, the infrared rays from the heating element 302 are hardly emitted in the negative direction of the x axis, that is, in the direction wherein the infrared rays are shielded by the reflection film 301*a* (in the left direction in the part (b) of FIG. 14).

When the intensity distribution curve 307*d* in the part (a) of FIG. 14 is compared with the conventional intensity distribution curve 271 indicated in the part (a) of FIG. 26, the emission intensity in the conventional intensity distribution curve 271 is substantially uniform in a wide angle range near an area in the positive direction of the x axis. On the other hand, in the case of the fourth embodiment, the emission intensity gradually lowers as the distance from the x axis in the positive direction thereof increases. As a result, the emission intensity in the fourth embodiment is larger than that of the conventional example, and the range wherein the intensity becomes a maximum value in the fourth embodiment is narrower than that in the conventional example.

The infrared ray lamp of the fourth embodiment is thus suited to a case wherein an object disposed in the positive direction of the x axis is locally heated for example.

In the infrared ray lamp of the fourth embodiment, the reflection film 301*a* is produced in accordance with the following forming process.

(1) The glass tube 301 is formed into a cylindrical shape. (Step 1)

(2) The heating element 302 and the like are disposed inside the glass tube 301, and the glass tube 301 is hermetically sealed. (Step 2)

(3) Gold is evaporated on the external face of the glass tube 301 thereby to form the reflection film 301*a*. (Step 3)

By forming the reflection film 301*a* as described above, the reflection film 301*a* can be formed by using the external shape of the glass tube 301. As a result, the reflection film 301*a* having an accurate semi-cylindrical shape can be formed-easily.

In the above-mentioned process for forming the reflection film 301*a*, step 3maybe carried out before step 2.

Furthermore, the reflection film 301*a* may be formed by transfer or the like, instead of evaporation. In this case, transfer is carried out as described below.

(1) A mixture of resin, gold and glass is formed into a film and bonded to the surface of the glass tube 301.

(2) The film bonded to the surface of the glass tube 301 is baked thereby to vaporize the resin included in the film., Transfer is carried out as described above, and a gold film is formed on the surface of the glass tube 301.

Since the internal f ace of the reflection film 301*a* in the fourth embodiment, used as a reflection face, is made close contact with the external face of the glass tube 301, the internal face does not make contact with the air. In the conventional infrared ray lamp shown in the above-mentioned FIG.,25, the reflection plate 280 is disposed with a predetermined space provided from the glass tube 201; for this reason, the reflection face of the reflection plate 280 is stained with adherents and the like from the outside; however, this kind of problem has been solved in the fourth embodiment.

In the fourth embodiment, the reflection film 301*a* is formed into the shape of the external face of the glass tube 301, that is, a semi-cylindrical shape, and is maintained in the shape. The reflection film can be maintained at substantially similar shape for a longer time than the reflection plate 280 used for the conventional infrared ray lamp.

As described above, in the fourth embodiment, the reflection film 301*a* is maintained for a long time, and the reflectivity of its reflection face does not lower. The infrared ray lamp of the fourth embodiment therefore maintains its good characteristics for a longer time in comparison with the structure wherein the reflection plate 280 is installed in the conventional infrared ray lamp.

In the fourth embodiment, the structure wherein the reflection film 301*a* is formed on the external face of the glass tube 301 is described as an example; however, the present invention is not limited to this structure; the structure wherein a reflection film formed on the internal face of the glass tube may be used. However, in the case of such a structure, step 3 must be carried out before step 2 in the above-mentioned process for forming the reflection film.

In the case when the reflection film is formed on the internal face of the glass tube 301, the reflection film is not exposed to the air, and its reflection face is not stained with adherents and the like. For this reason, just as in the case when the reflection film is formed on the external face of the glass tube 301, the good characteristics of the reflection film are maintained for a longer time without causing any changes with time in comparison with the case when the reflection plate 280 is used for the conventional infrared ray lamp. However, since the reflection film formed on the internal face of the glass tube makes contact with the high-temperature gas inside the glass tube, the thickness of the reflection film may be reduced by evaporation, dispersion and the like, and its reflectivity may lower. For this reason, in the case when the reflection film is formed on the internal face of the glass tube, the distance between the reflection film and the heating-element is required to be set at a sufficiently large value.

Although gold used as the material of the reflection film 301*a* is described as an example in the fourth embodiment, metals other than gold, such as titanium nitride, silver and aluminum, can be used; metals having high reflectivity for infrared rays and being stable at high temperatures are applicable.

The reflection film 301*a* having a semi-cylindrical shape is described as an example in the fourth embodiment; however, the present invention is not limited to this shape; various shapes are applicable in consideration of the reflection direction of infrared rays. Instead of the semi-cylindrical shape, the shape of a part of a circle, a parabola or an ellipse in cross section for example may be used as the shape of the reflection film. Furthermore, it is possible to use a shape formed of a combination of plural straight lines, such as a part of a polygon (the shape of the letter ⊐ for example (or the shape of a bathtub)) or a shape formed of a combination of straight and curved lines (the shape of the letter U for example) or a flat shape in cross section. The shape of the reflection film 301*a* should only be a shape suited for obtaining the desired directional distribution of the emission intensity of infrared rays. To form the reflection film 301*a* having this kind of shape, the portion of the glass tube wherein the reflection film 301*a* is formed by evaporation or the like should only be formed into a shape corresponding to the desired shape of the reflection film; this can be attained easily by taken the method of forming the reflection film 301*a* described before.

Fifth Embodiment

Next, a fifth embodiment of the present invention will be described referring to the accompanying drawings. However, the materials, sizes, production methods and the like of the embodiment described below are only examples preferable for an embodiment of the present invention. The applicable range of the present invention is therefore not limited by these examples.

Part (a) of FIG. 15 is a plan view showing an infrared ray lamp in accordance with the fifth embodiment of the present invention, and part (b) is a front view thereof. In addition, FIG. 16 is a perspective view showing the infrared ray lamp of FIG. 15. However, since the central portion of the infrared ray lamp can be understood from both side portions shown in the figures, the central portion of the infrared ray lamp is not shown in either of the figures.

Furthermore, in the fifth embodiment, the same components as those of the third embodiment shown in FIGS. 9 and 10 are designated by the same numerals, and their explanations are omitted.

The infrared ray lamp of the fifth embodiment has a reflection film 301*b* for infrared rays in addition to the structure of the third embodiment, just as in the case of the above-mentioned fourth embodiment. However, in the infrared ray lamp of the fifth embodiment, the reflection film 301*b* is formed on the external face of the glass tube 301 at a position different from that in the above-mentioned fourth embodiment. Although the reflection film 301*a* of the fourth embodiment is disposed so as to be opposed to the wider side portion 2*a* of the heating element 302 (FIGS. 12 and 13), the reflection film 301*b* of the fifth embodiment is disposed so as to be opposed to the narrower side portion 2*b* of the heating element 302.

The material, thickness, reflectivity, shape and forming method of the reflection film 301*b* of the fifth embodiment are similar to those of the reflection film 301*a* of the fourth embodiment.

Part (a) of FIG. 17 is a graph showing the distribution curve 307*e* of the intensity of the infrared rays emitted from the heating element 302 of the fifth embodiment. Part (b) of FIG. 17 shows the cross section of the central portion of the infrared ray lamp of the fifth embodiment having the heating element 302. The x and y axes shown in the parts (a) and (b) of FIG. 17 are orthogonal coordinate axes on a plane perpendicular to the axial direction of the heating element 302 shown in FIG. 16. The x axis corresponds to the thickness direction of the heating element 302, and the y axis corresponds to the width direction thereof. In the parts (a) and (b) of FIG. 17, the origin 0 corresponds to the center axis of the heating element 302. In the part (a) of FIG. 17, the values in the radial directions designate the emission intensity of the infrared rays, and the values in the circumferential directions designate angles with respect to the center axis on the plane perpendicular to the axial direction of the heating element 302. These angles are designated by angles from the positive direction of the x axis. The concentric gradations for the emission intensity in the part (a) of FIG. 17 indicate the same values of the gradations in the part (a) of FIG. 11.

In addition, a constant power of 600 W is applied to the infrared ray lamp. Since the measurement method is the same as that of the third embodiment, its explanation is omitted.

In the infrared ray lamp of the fifth embodiment, the positive direction of the y axis (the direction of the arrow of the y axis in FIGS. 16 and 17) is the direction of the internal face of the reflection film 301*b*.

As shown in the intensity distribution curve 307*e* of the infrared ray emission in the part (a) of FIG. 17, the emission intensity of the infrared rays from the heating element 302 in the vicinity of the y axis in the positive direction thereof is lower than that in the vicinity of the x-axis direction. On the y axis side in the negative direction thereof, emission is restricted by the reflection film 301*b* as a matter of course.

When the intensity distribution curve 271 of the conventional infrared ray lamp shown in the part (a) of the above-mentioned FIG. 26 is compared with that of the fifth embodiment, the angle range in the direction wherein the emission intensity is high in the fifth embodiment is wider than that in the conventional example.

As a result, the infrared ray lamp of the fifth embodiment is suited, for example, in the case when the center of an object to be heated is placed on the y axis of the infrared ray lamp in the positive direction thereof and in the case when the entire flat face of the object to be heated, which is perpendicular to the y axis, is heated uniformly.

Sixth Embodiment

Next, a heating apparatus using the infrared ray lamp in accordance with the present invention will be described as a sixth embodiment.

The infrared ray lamp described in the above-mentioned third embodiment is used as the infrared ray lamp for the heating apparatus of the sixth embodiment, and the reflection plate 280 shown in FIG. 25 is provided for this infrared ray lamp.

All of the above-mentioned infrared ray lamps in accordance with the above-mentioned first to fifth embodiments are structured to have substantially similar external shape as that of the conventional infrared ray lamp. For this reason, in a heating apparatus having the conventional infrared ray lamp, it is easy for ordinary engineers skilled in the related art to replace the infrared ray lamp with one of the infrared ray lamps in accordance with the first to fifth embodiments.

Heating apparatuses each having the conventional infrared ray lamp that is replaceable with the infrared ray lamp of the present invention as described above are the following apparatuses, for example.

(1) Heating apparatuses, such as a heater, a kotatsu (a Japanese traditional heating device), an air conditioner, an infrared treatment apparatus and a bathroom heater (2) Drying apparatuses, such as a clothing drier, a bedding drier, a food treatment apparatus, a garbage treatment apparatus, a heating-type deodorizing apparatus and a bathroom drier (3) Heating-type sterilizing apparatuses (4) Cooking apparatuses, such as an oven, an oven range, an oven toaster, a toaster, a roaster, a warming apparatus, a yakitori cooker (skewered chicken cooker), a cooking stove, a defroster and a brewer (5) Hairdressing apparatuses, such as a drier and a permanent wave heater (6) Apparatuses for fixing letters, images, etc. on sheets (a) Apparatuses for carrying out display by using toner, such as an LBP (laser beam printer), a PPC (plain paper copier) and a facsimile (b) Apparatuses for thermal transfer of an original film to an object by heating (7) Soldering heaters (8) Driers for semiconductor wafers, etc.

(9) Apparatuses for heating pure water when cleaning wafers, etc. in semiconductor production processes, and

(10) Industrial coating driers

In other words, an apparatus for heating objects by using an infrared ray lamp as a heat source can be an apparatus whose infrared, ray lamp can be replaced with as described above.

FIG. 18 is a perspective view showing the positional relationship between the infrared ray lamp and the infrared ray reflection plate 308*a* of the heating apparatus of the sixth embodiment. In FIG. 18, the central portion of the infrared ray lamp is not shown. Furthermore, since the infrared ray lamp used herein is the infrared ray lamp described in the above-mentioned third embodiment, its explanation is omitted.

The reflection plate 308*a* of the sixth embodiment is formed of aluminum, has a semi-cylindrical shape measuring about 0.4 to 0.5 mm in thickness, and has a mirror-finished reflection face on its internal face. The infrared ray reflectivity of the reflection plate 308*a* is about 80 to 90%. The reflection plate 308*a* is disposed in parallel with the center line of the heating element 302, with a predetermined space provided from the external face of the glass tube 301. The reflection plate 308*a* is installed by using the center line of the heating element 302 as its center. As shown in FIG. 18, the reflection face, that is, the internal face of the reflection plate 308*a*, is disposed so as to be opposed to the wider side portion 302*a* of the heating element 302.

The reflection plate 308*a* formed of aluminum is explained as an example in the sixth embodiment; however, instead of aluminum, materials having high infrared ray reflectivity and being stable at high temperatures, such as gold, titanium nitride, silver and stainless steel, are applicable.

The reflection plate 308*a* having a semi-cylindrical shape is explained in the sixth embodiment; however, its cross section can also take other shapes, for example, a shape having a part of a circle, a parabola or an ellipse; or a shape formed of a combination of plural straight lines, such as a part of a polygon (the shape of the Japanese letter ㄱ for example), a shape formed of a combination of them (the shape of the English letter "U" for example) or a flat shape; the shape should only be a shape suited for obtaining the desired directional distribution of the emission intensity of infrared rays.

By installing the reflection plate 308*a* as described above, the directional distribution of the emission intensity of the infrared rays has substantially similar shape as that of the intensity distribution curve 307*d* in the fourth embodiment shown in the part (a) of the above-mentioned FIG. 14. With the above-mentioned structure, it is possible to obtain infrared rays having similar directional distribution of the emission intensity as that of the infrared ray lamp of the fourth embodiment. As a result, the heating apparatus of the sixth embodiment is suited for a use wherein an object disposed at a position opposed to the reflection face of the reflection plate 308*a* is heated locally for example.

The emission intensity of the infrared ray lamp of the third embodiment has directivity in the x-axis direction as shown in FIG. 11. For this reason, in the heating apparatus of the sixth embodiment, the emission intensity of the infrared rays by the reflection plate 308*a* becomes higher than that of the conventional example. In addition, in the case when the reflectivity of the reflection plate 308*a* is reduced considerably because of changes with time, the adherence of stains, etc., the effect on the directional distribution of the emission intensity in the sixth embodiment is less than that in the case when the conventional infrared ray lamp shown in FIG. 22 is used for example.

Seventh Embodiment

Next, a heating apparatus using the infrared ray lamp in accordance with the present invention will be described as a seventh embodiment.

The infrared ray lamp of the heating apparatus of the seventh embodiment is structured such that the reflection plate 308*a* described in the above-mentioned sixth embodiment is disposed 90 degrees rotated around the center line of the infrared ray lamp.

FIG. 19 is a perspective view showing the positional relationship between the infrared ray lamp and the infrared ray reflection plate 308*b* of the heating apparatus of the seventh embodiment. However, in FIG. 19, the central portion of the infrared ray lamp is not shown. Furthermore, since the infrared ray lamp used herein is the infrared ray lamp described in the third embodiment, its explanation is omitted.

As shown in FIG. 19, the reflection face, that is, the internal face of the reflection plate 308*b*, is disposed so as to be opposed to the narrower side portion 302*b* of the heating element 302.

By disposing the reflection plate 308*b* as described above, the directional distribution of the emission intensity of infrared rays is substantially equal to that of the fifth embodiment shown in the part (a) of the above-mentioned FIG. 17. In other words, similar directional distribution of the emission intensity as that of the fifth embodiment can be obtained by using the infrared ray lamp of the third embodiment. The heating apparatus of the seventh embodiment is thus suited for a use wherein the entire flat face of an object placed in parallel with the heating element 302 and opposed to the reflection plate 308*b* is heated substantially uniformly for example.

Furthermore, the infrared ray lamp of the third embodiment shown in FIG. 10 has directivity in emission intensity as shown in FIG. 11 by itself. For this reason, in the heating apparatus of the seventh embodiment, in the case when the reflectivity of the reflection plate 308*b* is reduced considerably because of changes with time, the adherence of stains, etc., the effect on the directional distribution of the emission intensity is less than that in the case when the conventional infrared ray lamp shown in FIG. 22 is used for example.

In the infrared ray lamp of the present invention, the intensity of the infrared rays emitted from the heating element has directivity described below. In other words, the emission intensity of the infrared rays becomes a maximum value in the thickness direction of the heating element, and the intensity in the width direction of the heating element has a small value that is substantially negligible in comparison with the maximum value. The conventional reflection plate is not required to be used for such a use wherein an infrared ray lamp having such directivity is suited, whereby the lamp can be structured simply. The infrared ray lamp having this structure does not cause reduction in the reflectivity of the reflection plate, thereby preventing reduction in efficiency.

In addition, in the case when the infrared ray lamp of the present invention has a reflection film, the intensity distribution curve of the emission of the infrared rays emitted from the heating element can be adjusted to have a predetermined shape. As a result, the intensity of the infrared rays emitted in unnecessary directions can be restricted, whereby the infrared ray lamp of the present invention exhibits good emission efficiency. Furthermore, unlike the reflection plate, the reflection face of the reflection film is not stained by external adherents and the like. Moreover, changes with time in the shape of the reflection film and the like are less significant than those of the reflection plate. As a result, the high reflectivity of the reflection film is maintained for a longer period than that of the reflection plate. The infrared ray lamp of the present invention therefore maintains its good characteristics for a long time.

In the infrared ray lamp of the present invention, by providing the reflection film at a position desirable for the heating element, the intensity of the infrared rays reflected by and emitted from the reflection film can be increased in a specific direction, and the range of the high emission intensity can be narrowed. As a result, the infrared ray lamp of the present invention having this kind of reflection film becomes a device suited for a use wherein the area in the direction opposed to the reflection film is heated locally, for example, suited for fixing and the like in a copier.

Furthermore, in the infrared ray lamp of the present invention, by providing the reflection film at another position desirable for the heating element, the intensity of the infrared rays reflected by and emitted from the reflection film can be made substantially the same, whereby the range of the emission intensity can be widened. As a result, the infrared ray lamp of the present invention having this kind of reflection film becomes a device suited for a use wherein the entire flat face of an object placed in parallel with the heating element and opposed to the reflection film is heated uniformly, for example, suited for a toaster.

In the method of producing the infrared ray lamp in accordance with the present invention, the reflection film is formed by using the shape of the glass tube. This facilitates the formation of the semi-cylindrical reflection film.

In the heating apparatus in accordance with the present invention, the infrared ray lamp of the present invention has similar shape as that of the conventional infrared ray lamp; for this reason, the infrared ray lamp of the conventional heating apparatus can be replaced with the infrared ray lamp of the present invention. As a result, by providing the conventional heating apparatus with the infrared ray lamp having directivity in the emission intensity of infrared rays, a heating apparatus having good characteristics can be obtained, and the heating apparatus can be used for heating objects or rooms.

In the heating apparatus of the present invention, by installing the semi-cylindrical reflection plate instead of the reflection film, the direction curve of the intensity of the emission of the infrared rays can be adjusted to have a predetermined shape. With this structure of the infrared ray lamp of the heating apparatus of the present invention, the intensity of the infrared rays emitted in unnecessary directions can be restricted. In addition, even if the reflectivity of the reflection plate lowers, the directivity of the infrared ray lamp is not so affected as in the case of the conventional apparatus, since the infrared ray lamp has directivity. For this reason, the heating efficiency of the heating apparatus in accordance with the present invention is superior to that of the conventional apparatus.

In the heating apparatus in accordance with the present invention, by providing the reflection film at a position desirable for the heating element, the intensity of the infrared rays reflected by and emitted from the reflection film can be increased in a specific direction, and the range of the high emission intensity can be narrowed. As a result, the heating apparatus of the present invention having this kind of reflection film becomes a device suited for a use wherein the area in the direction opposed to the reflection film is heated locally.

Furthermore, in the heating apparatus of the present invention, by providing the reflection film at another position desirable for the heating element, the intensity of the infrared rays reflected by and emitted from the reflection film can be made substantially the same, whereby the range of the emission intensity can be widened. As a result, the heating apparatus of the present invention having this kind of reflection film becomes a device suited for a use wherein the entire flat face of an object placed in parallel with the heating element and opposed to the reflection film is heated uniformly.

Although the present invention has been described in terms of the presently preferred embodiments, it is to be understood that such disclosure is not to be interpreted as limiting, but various alterations and modifications will no doubt become apparent to those skilled in the art to which the present invention pertains, after having read the above disclosure; accordingly, it is intended that the appended claims be interpreted as covering all alterations and modifications as fall within the true spirit and scope of the invention.

INDUSTRIAL APPLICABILITY

The present invention, relating to a heating apparatus for heating objects, rooms, etc., can provide a heating apparatus that emits infrared rays highly efficiently and has a long life by using an infrared ray lamp widely used as a heat source, and can also provide a versatile apparatus wherein the directivity of infrared ray emission can be selected depending on an object to be heated.

What is claimed is:

1. An infrared ray lamp comprising:

at least one heating element having a substantially plate shape or rod shape, having recessed portions in the vicinities of both ends thereof and formed of a carbon-based substance, heat-emitting blocks having good conductivity to which both end portions of said heating element are inserted and bonded, a sintered substance of an adhesive formed and sintered on the bonding faces of said heating element bonded to said heat-emitting blocks at the reasons in the vicinities of both end portions including the recessed portions of said heating element, a glass tube in which said heating element, said sintered substance of said adhesive and said heat-emitting blocks are hermetically sealed together with an inert gas, and lead wires electrically connected to said heat-emitting blocks, the end portions of which are led out of said glass tube.

2. An infrared ray lamp in accordance with claim 1, wherein a groove is formed in the face of said heat-emitting block bonded to said heating element.

3. An infrared ray lamp comprising:

at least one heating element having a substantially plate shape, having recessed portions in the vicinities of both ends thereof, and formed of a carbon-based substance, heat-emitting blocks having good conductivity and each split into two pieces, between which both end portions of said heating element are sandwiched, a sintered substance of an adhesive formed and sintered on the bonding faces of said heating element bonded to said heat-emitting blocks at the regions in the vicinities of both end portions including the recessed portions of said heating element, a glass tube in which said heating element, said sintered substance of said adhesive and said heat-emitting blocks are hermetically sealed together with an inert gas, and lead wires electrically connected to said heat-emitting blocks, the end portions of which are taken outside said glass tube.

4. An infrared ray lamp in accordance with claim 3, wherein a projected portion is formed on at least one of said heat-emitting blocks so as to be fitted into said recessed portion of said heating element.

5. An infrared ray lamp in accordance with claim 1, 2, 3 or 4, wherein said heat-emitting blocks are formed of a carbon-based sintered substance.

6. An infrared ray lamp in accordance with claim 1, 2, 3 or 4, wherein said adhesive is formed of a liquid carbon-based substance that becomes a carbon-based sintered substance when heated.

7. A method of producing an infrared ray lamp comprising:

a step of forming recessed portions in the vicinities of both ends of at least one heating element having a substantially plate shape or rod shape and formed of a carbon-based substance, a step of applying a liquid adhesive formed of a carbon-based organic substance to the regions in the vicinities of both ends including the recessed portions of said heating element, a step of inserting and bonding both end portions of said heating element to the end portions of heat-emitting blocks having good conductivity by using said adhesive, a step of drying and firing said heat-emitting blocks and said heating element bonded to each other, and a step of sealing said heating element and said heat-emitting blocks inside a glass tube together with an inert gas, and of taking the end portions of the lead wires electrically connected to said heat-emitting blocks outside said glass tube.

8. An infrared ray lamp comprising:

a heating element having a substantially plate shape, the width of which is larger than its thickness by five times or more, a glass tube in which said heating element is hermetically sealed, an electrode embedded at both end portions of said glass tube, electrically connected to both ends of said heating element respectively and also electrically connected to an external electric circuit a connection device secured to both end portions of said heating element respectively and electrically connected to said heating element, and lead wires secured to said connection devices and said electrodes so as to pull both ends of said heating element at a predetermined tension and used to electrically connect said connection devices to said electrodes wherein said connection device having a heat-emitting block, the cross-sectional area of which is larger than the cross-sectional area of said heating element on a plane perpendicular to the direction of the current flowing through said heating element, in order to prevent said lead wires from being overheated by emitting heat transmitted from said heating element.

* * * * *

UNITED STATES PATENT AND TRADEMARK OFFICE

CERTIFICATE OF CORRECTION

PATENT NO. : 6,654,549 B1
DATED : November 25, 2003
INVENTOR(S) : Masanori Konishi It is certified that error appears in the above-identified patent and that said Letters Patent is hereby corrected as shown below:

Column 8,
Line 22, please delete “in FIG.”, and insert therefor -- in FIG. 1; --.

Column 13,
Line 48, pleaes delete “of A the”, and insert therefor -- of the --.

Column 24,
Line 60, please delete “internal f ace”, and insert therefor -- internal face --.
Line 65, please delete “FIG., 25”, and insert therefor -- FIG. 25 --.

Signed and Sealed this

Fourth Day of May, 2004

JON W. DUDAS
*Acting Director of the United States Patent and Trademark Office*